US005984625A

United States Patent [19]

Murray et al.

[11] Patent Number: 5,984,625

[45] Date of Patent: Nov. 16, 1999

[54] ACTUATOR BANDWIDTH AND RATE LIMIT REDUCTION FOR CONTROL OF COMPRESSOR ROTATING STALL

[75] Inventors: Richard M. Murray; Simon Yeung, both of Pasadena, Calif.

[73] Assignee: California Institute of Technology, Pasadena, Calif.

[21] Appl. No.: 08/951,439

[22] Filed: Oct. 15, 1997

Related U.S. Application Data

[60] Provisional application No. 60/028,407, Oct. 15, 1996, provisional application No. 60/037,774, Feb. 13, 1997, and provisional application No. 60/055,411, Aug. 7, 1997.

[51] Int. Cl.[6] ..... F01D 17/00

[52] U.S. Cl. ..... 415/1; 415/13; 415/14; 415/26; 415/36; 415/47; 415/48; 415/118; 415/914

[58] Field of Search ..... 415/13, 14, 20, 415/26, 1, 28, 119, 118, 914, 36, 48, 47

[56] References Cited

U.S. PATENT DOCUMENTS

| | | | |
|---|---|---|---|
| 3,848,636 | 11/1974 | McCombs | 137/624.27 |
| 5,005,353 | 4/1991 | Acton et al. | 60/39.281 |
| 5,297,930 | 3/1994 | Moore | 415/182.1 |
| 5,340,271 | 8/1994 | Freeman et al. | 415/1 |
| 5,375,412 | 12/1994 | Khalid et al. | 60/39.29 |
| 5,586,857 | 12/1996 | Ishii et al. | 415/23 |
| 5,707,206 | 1/1998 | Goto et al. | 415/173.1 |
| 5,709,526 | 1/1998 | McLeister et al. | 415/1 |
| 5,782,603 | 7/1998 | O'Brien et al. | 415/1 |

OTHER PUBLICATIONS

Baran, et al., Indicators of Incipient Surge for Three Turbofan Engines Using Standard Equipment and Instrumentation; The International Gas Turbine and Aeroengine Congress & Exhibition; Buffalo, NY, Jun. 1996.

Robert L. Behnken, Nonlinear Control and Modeling of Rotating Stall in an Axial Flow Compressor; Pasadena, California at California Institute of Technology; Thesis Sep. 1996.

Behnken, et al. Characterizing the Effects of Air Injection on Compressor Performance for Use in Active Control of Rotating Stall; Submitted to The International Gas Turbine and Aeroengine Congress and Exhibition; Pasadena, Ca, 1997.

D'Andrea, et al., Active Control of Rotating Stall Using Pulsed Air Injection: A Parametric Study on a Low–Speed, Axial Flow Compressor; Proceedings of SPIE; 2492:152–165; Pasadena, CA, 1995.

I.J. Day, Active Suppression of Rotating Stall and Surge in Axial Compressors; ASME Journal of Turbomachinery, 115:40–47; Cambridge, United Kingdom, 1993.

Eveker, et al., Integrated Control of Rotating Stall and Surge in Aeroengines; Proceedings of SPIE, pp. 21–35; East Hartford, CT, Apr. 1995.

Moore, et al., A Theory of Post–Stall Transients in Axial Compression Systems: Part 1–Development of Equations; ASME Journal for Engineering for Power, 108:68–78; Ithaca, NY 1986.

(List continued on next page.)

*Primary Examiner*—Christopher Verdier
*Assistant Examiner*—Ninh Nguyen
*Attorney, Agent, or Firm*—Fish & Richardson P.C.

[57] ABSTRACT

A compressor is disclosed having a characteristic modifier, such as air injection, adapted to modify an operating characteristic of the compressor in order to reduce the bandwidth and rate limit requirements of the compressor. The compressor includes an actuator, such as a bleed valve, whose bandwidth and rate limit parameters meet the corresponding reduced requirements of the compressor. The actuator is adapted to stabilize the compressor with respect to a likely condition in the compressor which would tend to make the compressor operate in a less stable manner. This makes it possible to stabilize the compressor using a more readily available actuator having lower bandwidth and rate limit parameters.

61 Claims, 30 Drawing Sheets

OTHER PUBLICATIONS

Liaw, et al., Active Control of Compressor Stall Inception: a Bifurcation–Theoretic Approach; Automation, 32(1), 109–115; Great Britain, 1996.

Mansoux, et al., Distributed Nonlinear Modeling and Stability Analysis of Axial Compressor Stall and Surge; American Control Conference, pp. 2305–2316; Cambridge, MA at Massachusetts Institute of Technology, 1994.

Greitzer, et al., A Theory of Post–Stall Transients in Axial Compression Systems: Part II–Application; Journal of Engineering for Gas Turbines and Power; 108:231–239; Cambridge, MA, 1986.

Murray, et al., Sparrow Reference Manual; California Institute of Technology, Pasadena, CA, 1996.

Paduano, et al., Active Control of Rotating Stall in a Low–Speed Axial Compressor; ASME Journal of Turbomachinery, 115:48–56, Cambridge, MA 1993.

Freeman, et al., Experiments in Active Control of Stall on an Aeroengine Gas Turbine; ASME Technical Publishing, pp. 1–13; England, Jun. 1997.

van Schalkwyk, et al., Active Stabilization of Axial Compressors with Circumferential Inlet Distortion; ASME Technical Publishing, pp. 1–15; Woburn, MA, Jun. 1997.

Haynes, et al., Active Stabilization of Rotating Stall in a Three–Stage Axial Compressor; ASME Journal, 116:226–239; Cambridge, MA, Apr. 1994.

Wang, et al., Effects of Noise, Magnitude Saturation, and Rate Limits on Rotating Stall Control; Division of Engineering and Applied Science, California Institute of Technology, Pasadena, CA,.-

ACTUATOR BANDWIDTH AND RATE LIMIT REDUCTION FOR CONTROL OF COMPRESSOR ROTATING STALL

CROSS REFERENCE TO RELATED APPLICATIONS

This application claims the benefit of the following U.S. provisional patent applications: No. 60/028,407, filed Oct. 15, 1996; No. 60/037,774, filed Feb. 13, 1997; and No. 60/055,411, entitled "Nonlinear Control of Rotating Stall Using Axisymmetric Bleed with Continuous Air Injection on a Low-Speed, Single Stage, Axial Compressor," filed Aug. 7, 1997.

STATEMENT AS TO FEDERALLY SPONSORED RESEARCH

The U.S. Government may have certain rights in this invention pursuant to Grant No. F49620-95-1-0409 awarded by the United States Air Force.

FIELD OF THE INVENTION

This invention relates to compressors, and in particular, to reduction of actuator bandwidth and rate limit for control of compressor rotating stall.

BACKGROUND OF THE INVENTION

In gas-turbine engines, the compressor experiences two main types of instabilities, known as rotating stall and surge. Rotating stall is a flow separation that travels around the annulus of the compressor (referred to as a stall cell). Typical effects associated with stall include high mechanical stress level in the blading, large drop in performance, and possible turbine overheating due to the decreased flow. Furthermore, the rotating stall condition is irrecoverable in some systems due to the presence of a hysteresis loop, in which case a shut-down and restart of the entire engine is in order. Surge is a large flow oscillation in the compression system which induces high blade and casing stress levels and possible reverse flow which is detrimental to combustion and engine performance.

Active control of rotating stall and surge can lead to an increase in the stability of a compressor against various disturbances such as inlet distortions and power transients. As a result, a compressor with active controls can operate closer to the current stall/surge line.

Active control of rotating stall and surge has been modeled and tested by various researchers. Successful attempts at stabilization have been achieved using inlet guide vanes (IGV), bleed valves (BV), and air injection (AI) on a variety of research compressors. A simplified model was derived by Moore and Greitzer for a compressor that exhibits rotating stall and surge. Based on this model, Liaw and Abed derived a control law using a bleed valve for rotating stall. Attempts at control of rotating stall on a single-stage, low speed axial compressor at Caltech were carried out initially with a high speed bleed actuator and results were unfruitful due to the fast growth rate of the stall cell relative to the rate limit of the valve. For industrial applications where the compressors may be significantly more powerful (higher flow and pressure rise, higher rotor frequency, etc.) than research compressors, obstacles such as control actuator magnitude and rate saturation can become crucial in these active control methods. A method which reduces the rate requirements of actuators for purposes of active control of rotating stall in compressors can be valuable in circumventing possible actuator rate limitations that prevents successful active control implementation.

SUMMARY OF THE INVENTION

The present invention provides both an apparatus and method for controlling compressor instabilities by use of an actuator in combination with a compressor characteristic modifier that modifies an operating characteristic of the compressor.

According to specific embodiments of the invention the compressor characteristic modifier is capable of reducing the compressor's bandwidth and rate limit requirements from a prohibitively high level down to a useable level, and the actuator is provided having bandwidth and rate limit parameters at a corresponding useable level. In addition, sensing of data indicative of a likely compressor instability by use of a sensing device facilitates identification of the compressor's operating characteristic, as well as adjustment of the actuator during control of compressor stabilization.

According to further specific embodiments of the invention, rotating stall and surge can be controlled by the combination of an actuator, such as a bleed valve, and a characteristic modifier, such as air injection. The actuator can also be a plurality of bleed valves, including a combination of high speed and low speed bleed valves.

The air injection characteristic modifier can be provided by one or more air injectors having fixed or variable location, angle, and back pressure. Alternate embodiments of the characteristic modifier include treatment of the casing containing the compressor rotor and stator, inclusion of guide vanes (either partial or full) upstream of the rotor, hub distortion upstream of the rotor, and changes in individual blade properties, such as angle of attack, mass, stiffness and geometry.

The sensing device is one or more pressure transducers, with at least a portion of the transducers being mounted circumferentially around the compressor upstream of the rotor. The sensing device also can include a velocity sensor, such as a hotwire anemometer or hot film. The data from these devices related to surge is used to identify the compressor characteristic, and data related to stall is used to control the instabilities via the actuator.

Stabilization of the compressor using the actuator and characteristic modifier includes modifying the characteristic and adjusting the actuator to stabilize the compressor with respect to the unstable condition. Closed-loop control of the instabilities is achieved by repeatedly sensing stall data and adjusting the actuator. Closed-loop control can also include modifying the characteristic. Identification of the compressor characteristic occurs off-line prior to modification, and modification of the characteristic can occur offline prior to closed-loop control, as well.

DESCRIPTION OF THE PREFERRED EMBODIMENTS

The present invention provides both a method and an apparatus for reduction of actuator bandwidth and rate limit for active control of rotating stall and surge. Although active control of rotating stall and surge for low and high speed compressors is achievable using high bandwidth actuators, actuators with high enough bandwidth are not readily available for normal use. Combining an axisymmetric bleed valve with compressor characteristic actuation achieves the desired active control at bandwidths and rate limits in a useable range.

The present invention is demonstrated through mathematical modelling of the rotating stall and surge events, bleed valve actuation, and continuous air injection, and through theoretical prediction of bleed valve actuator requirements for rotating stall and surge stabilization. Experimental results of the analysis run on an experimental single-stage, low speed axial compressor system depict a confirmation of the theoretical predictions.

The notation used in this application is summarized below:

| | |
|---|---|
| a, B, $l_c$, m, $\mu$ | compressor model parameters |
| A | amplitude of first Fourier mode |
| $A_{nom}$ | amplitude of first Fourier mode of a fully developed stall cell |
| $\epsilon$ | noise level of the system expressed as a percentage of J |
| $\gamma$ | throttle coefficient |
| J | squared amplitude of first Fourier mode $= A^2$ |
| | $\Phi_T(\psi) = \gamma\sqrt{\psi}$ |
| $K_x$ | gain estimation from method X |
| $R_x$ | rate estimation from method X |
| $k_{RS}$ | gain for control of rotating stall in Liaw-Abed control law |
| $k_S$ | gain for control of surge in Eveker et al. control law |
| $\phi$ | nondimensionalized velocity |
| $\Phi_{T(\psi)}$ | throttle characteristic |
| $\psi$ | nondimensionalized pressure rise |
| $\Psi_c(\phi)$ | compressor characteristic |
| u | bleed valve control effort |
| $u_{mag}$ | magnitude saturation of the bleed actuator as percentage of $\phi^*$ |
| $x^*$ | x at peak of compressor characteristic |

Theory

To describe the basic behavior of the compression system, we make use of the low order model derived by Moore and Greitzer. The model comprises three ordinary differential equations (Equation (1)) describing the evolution of the flow, pressure rise, and the square of the amplitude of the first Fourier mode:

$$\dot{\psi} = \frac{1}{4l_cB^2}(\phi - \Phi_T(\psi)) \tag{1}$$

-continued $$\phi = \frac{1}{l_c}\left(\Psi_c(\phi) - \psi + \frac{J}{4}\frac{\partial^2 \Psi_c(\phi)}{\partial \phi^2}\right)$$

$$j = \frac{2a}{1+ma}J\left(\frac{\partial \Psi_c(\phi)}{\partial \phi} + \frac{J}{8}\frac{\partial^3 \Psi_c(\phi)}{\partial \phi^3}\right)$$

Figure 1:
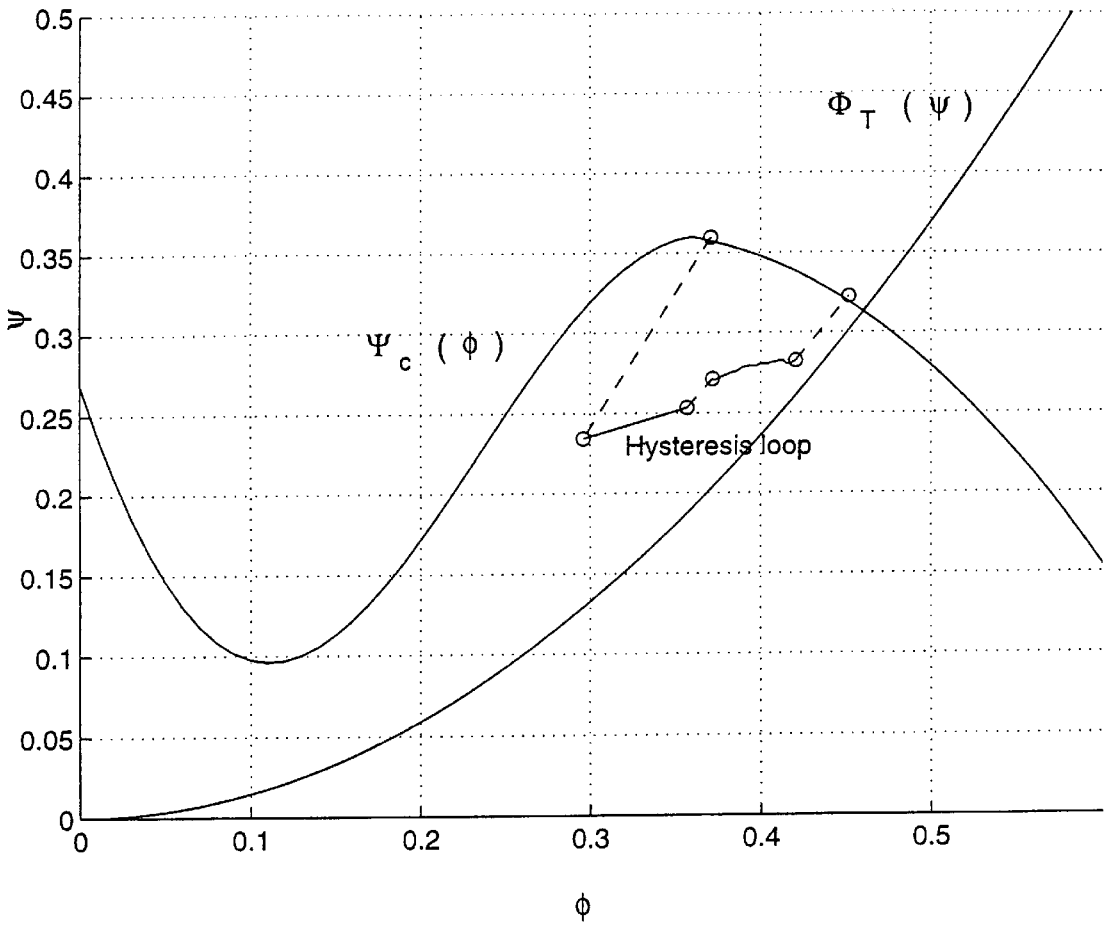
FIG. 1 is a graph of a typical compressor characteristic showing stalled operation.
Figure 2:
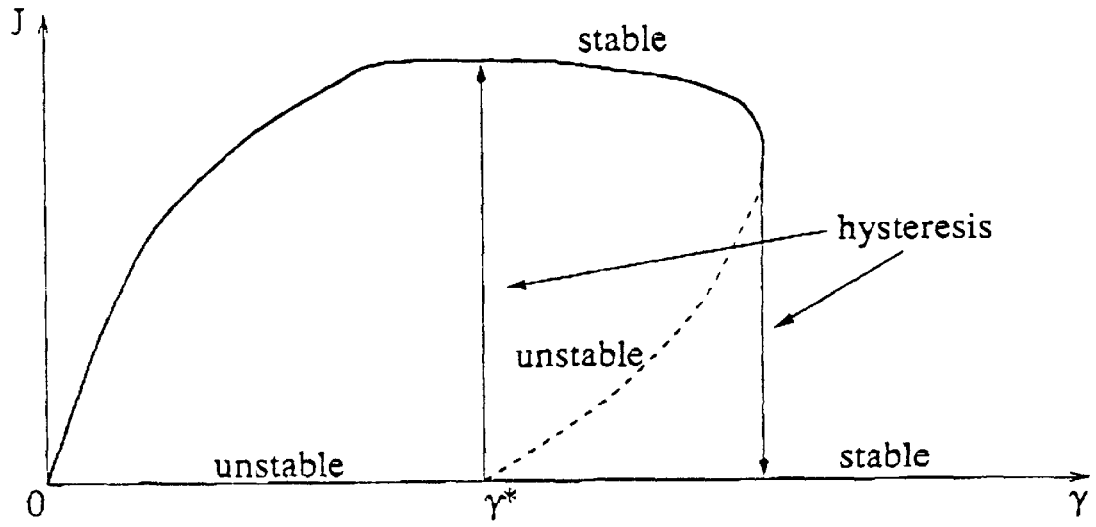
FIG. 2 is a graph showing transcritical bifurcation in the $\gamma$-J plane.

The compressor characteristic $\Psi_c(\phi)$ is a map containing information about the performance of the compressor at various values of the flow in the system. FIG. 1 shows an example of a compressor characteristic and a hysteresis loop associated with rotating stall obtained experimentally. The equilibria of the system are stable for large values of the throttle coefficient $\gamma$. As $\gamma$ is decreased, a critical value $\gamma^*$ is reached and the system exhibits a transcritical bifurcation in the J-$\gamma$ plane, as shown in FIG. 2. Since $J=A^2 \geqq 0$, we ignore the negative branch of the bifurcation diagram. At $\gamma=\gamma^*$, the stability of the J=0 equilibrium point changes from stable to unstable. However, there is a stable J>0 equilibrium that coexists with the J=0 equilibrium, and thus the system stalls. With J>0, if the value of $\gamma$ is increased, the system continues to stay along the J>0 branch of solution instead of unstalling immediately. The system eventually unstalls when the value of $\gamma$ reaches a point where the J>0 solution loses stability. This behavior is observed on axial compressors as the presence of a hysteresis loop due to rotating stall.

Liaw and Abed proposed a control law that modifies the throttle characteristic:

$$\Phi_T(\psi) = (\gamma + u)\sqrt{\psi}$$

$$u = k_{RS} J$$

Figure 3:
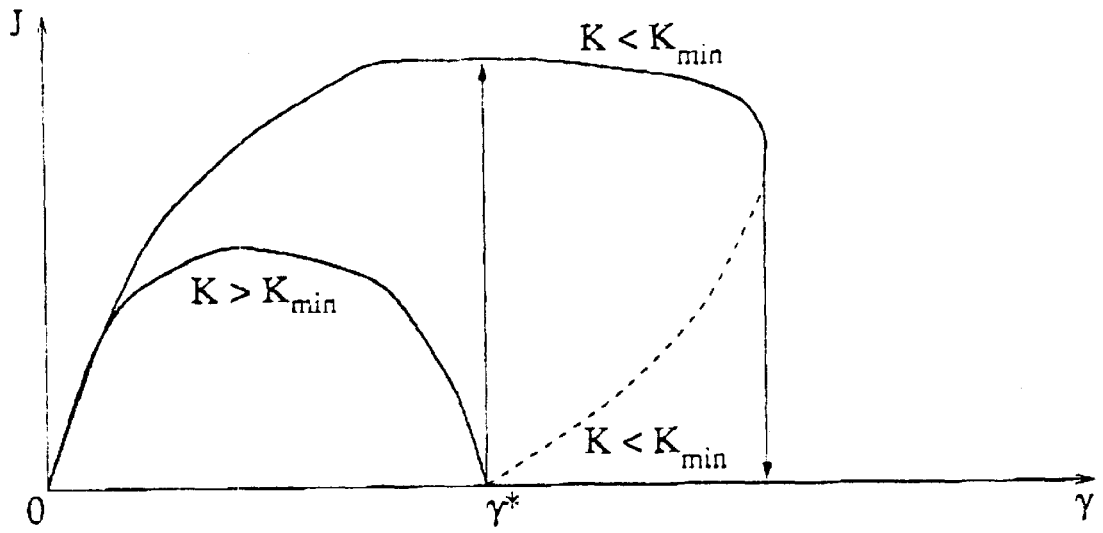
FIG. 3 is a graph of the relationship between controller gain and the behavior of bifurcation.

This control law can be realized experimentally through the use of a bleed valve. For a large enough value of K, the new branch of equilibrium solution created at $\gamma=\gamma^*$ "bends over" and eliminates the hysteresis loop. By substituting the control law and computing the quantity $dJ/d\gamma$ at the stall inception throttle coefficient $\gamma^*$, the minimum gain needed for this phenomenon to occur can be found by asserting the condition, as shown in FIG. 3, that:

$$\left(\frac{dJ}{d\gamma}\right)\Big|_{\gamma=\gamma^*} < 0$$

An expression for the minimum gain required for peak stabilization is given by (Equation (2)):

$$K_{\min} = K_{theory} = -\frac{\phi^* \Psi_c(\phi)}{8\gamma^* \psi^* \Psi_c(\phi)} - \frac{\gamma^* \Psi_c(\phi)}{8\psi^*} \tag{2}$$

which depends on the shape of the compressor characteristic. The present inventors have built on Equation (2) as an initial attempt to a theoretical tool for predicting the bleed valve requirement needed for peak stabilization.

Two rate expressions based on low order approximations are also used as theoretical tools to predict the rate of the bleed valve required for stabilization of stall. The rate expressions are provided by Wang et al. and are obtained by approximating the solution to a one-dimensional approximation to the Moore-Greitzer three-state model with a binary controller that opens the valve as fast as possible when the instability size is greater than the noise level of the system. The resulting rate estimates are referred to as $R1_{theory}$ and $R2_{theory}$ given by:

$$R1_{theory} = \frac{u_{mag}}{1 + \frac{\pi}{8}\sigma\eta^2 \arctan\left(\frac{\pi}{4}\sigma\eta\right)}$$

$$R2_{theory} = u_{mag}\left(1 - \frac{\frac{2}{\pi}\arctan\left(\frac{\pi}{4}\sigma\eta\right)}{1 - \frac{\sigma}{1+\sigma}\frac{2}{\pi}\arctan\left(\frac{\pi}{4}\sigma\eta\right)}\right)$$

where $$\sigma = \frac{-\alpha u_{mag}}{\alpha_2 \epsilon} \qquad \alpha_1 = \frac{2\sqrt{\psi^*}\,\Psi_c(\phi)}{m+\mu}$$

$$\eta = \frac{\alpha_2 \epsilon u_{mag}}{u_{rate}} \qquad \alpha_2 = \frac{1}{4(m+\mu)}\left(\Psi_c(\phi) + \frac{\gamma^* \Psi_c(\phi)^2}{\sqrt{\psi^*}}\right)$$

Based on the distributed modeling structure proposed by Mansoux et al. and the first order approximation of modeling the unsteady loss dynamics proposed by Haynes et al., a package written in C is used as the simulation tool referred to as the Quasi-Reality simulations (QRSIM). The simulation settings used for this study has 34 states for the compressor variables. The bleed valve is modeled as a third order linear system. The identified compressor characteristics from the experimental settings on which peak stabilization are obtained on the experiments are used in the simulation to predict the gain and rate requirements for peak stabilization in the simulation. The resulting gain and rate estimates are referred to as $K_{simu}$ and $R_{simu}$ respectively.

By changing the compressor characteristic, the bleed valve requirement needed for peak stabilization can be altered. The effects of continuous air injection on a compression system can be modeled as a shift in the compressor characteristic by including the air injection as part of the semi-actuator disc that approximates the compressor. Thus, by using air injection, the bleed valve requirement for peak stabilization can theoretically be modified.

Compressor System

Figure 4:
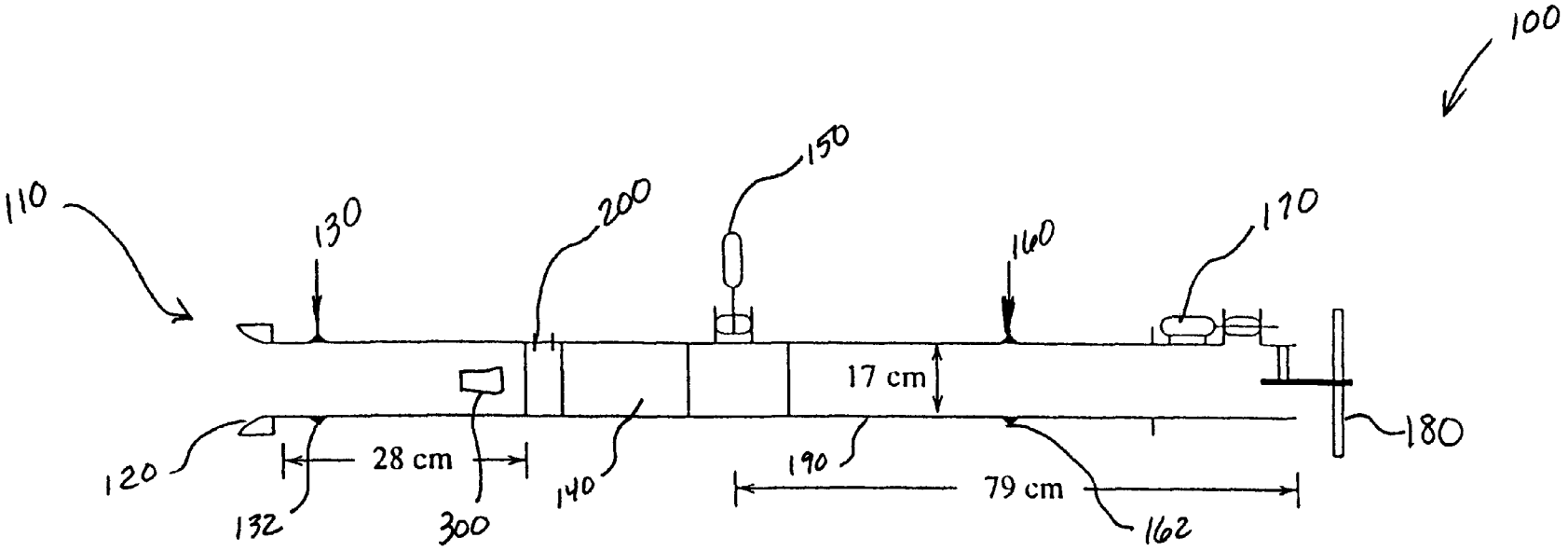
FIG. 4 is a diagram of the compressor system of the present invention.
Figure 5B:
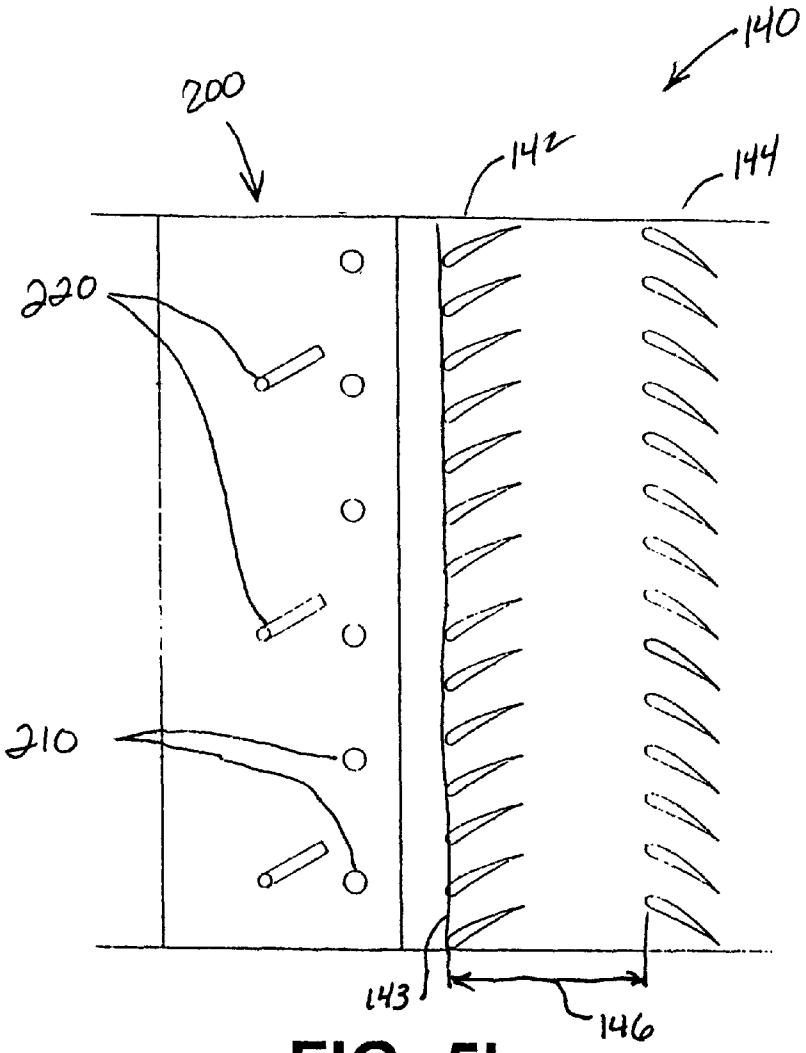
FIG. 5*b* is a diagram of a side view of the sensor ring and the axial flow fan of the compressor shown in FIG. 4.
Figure 5A:
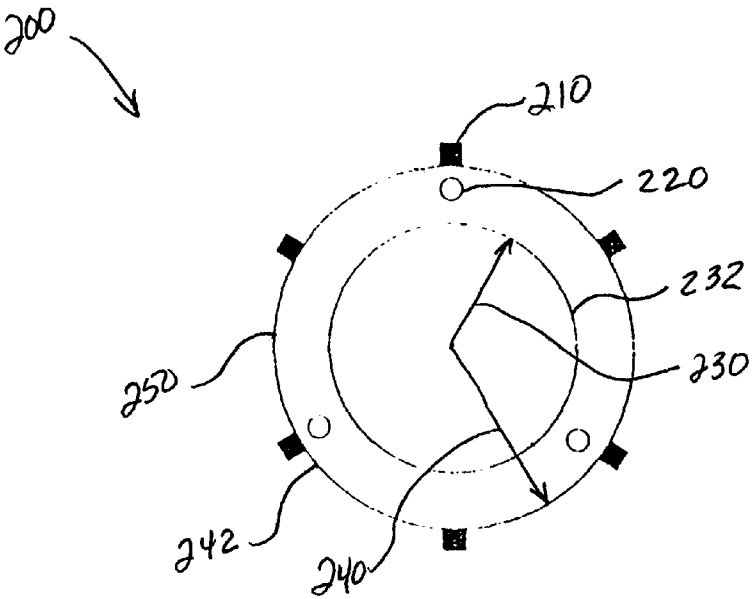
FIG. 5*a* is a diagram of an axial view of the sensor ring of the compressor shown in FIG. 4.

The Caltech compressor rig 100 is a single-stage, low speed axial compressor with sensing and actuation capabilities. FIG. 4 shows a drawing of the rig 100 and FIGS. 5*a* and 5*b* show magnified views of the sensor and injection actuator ring 200.

The compressor 110 is an Able Corporation model 29680 low speed, single-stage axial compressor with 14 blades 142 and 144, a tip radius 240 of 8.5 cm, and a hub radius 230 of 6 cm. The blade stagger angle (not shown) varies from 30° at the tip 242 to 51.6° at the hub 232, and the rotor to stator distance 146 is approximately 12 cm.

An exemplary rotor frequency of 100 Hz, gives a tip Mach number of 0.17. Rotating stall is observed under this condition on the rig 100 with a frequency of 65 Hz while surge occurs at approximately 1.7 Hz. Data taken for a stall transition event suggests that the stall cell grows from the noise level to its fully developed size in approximately 30 msec (approximately 3 rotor revolutions). At stall inception point, the velocity of the flow through the compressor 110 is approximately 16 m/sec.

Six static pressure transducers 210 with 1000 Hz bandwidth are evenly distributed around the annulus 250 of the compressor 110 at approximately 5.7 cm from the rotor face 143.

A discrete Fourier transform is performed on the signals from the transducers 210, and the amplitude and phase of the first and second mode of the pressure perturbation are obtained. The difference between the pressure obtained from one static pressure transducer 132 mounted at the piezostatic ring 130 at the inlet nozzle 120 and the pressure from one static pressure transducer 162 mounted at another piezostatic ring 160 downstream near the throttle 180 of the system is computed as the pressure rise across the compressor 110. All of the static pressure transducer signals are filtered through a fourth order Bessel low pass filter with a cutoff frequency of 1000 Hz before the signal processing phase in the software. For the velocity of the system, a hotwire anemometer 300 is mounted approximately 13.4 cm (approximately 1.6 rotor radii) upstream of the rotor face 143.

Figure 6:
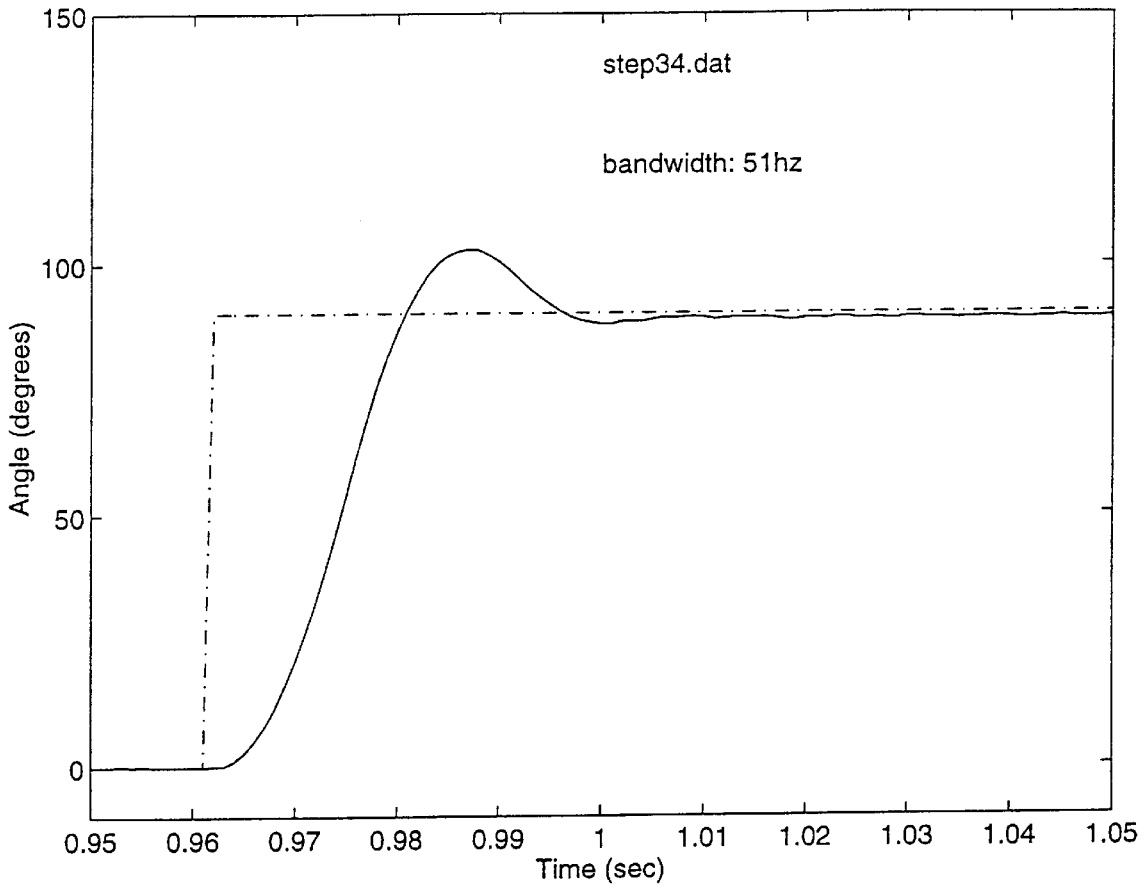
FIG. 6 is a graph of a typical step response of a bleed valve used for control of surge and throttle disturbance.

The nature of the decoupled frequencies of rotating stall and surge allows the use of two separate bleed valves 150 and 170 for the two types of instabilities, namely a high speed valve 150 for control of stall and a low speed valve 170 for control of surge and throttle disturbance generation. The high speed valve 150 has a magnitude saturation of 12% of the flow at the stall inception point. The low speed valve 170 has a magnitude saturation of 30% of the flow of the system at the stall inception point and is estimated to have a small signal (±5° angle modulation) bandwidth of 50 Hz and a large signal (±90° angle modulation) bandwidth of 15 Hz. A typical step response of this bleed valve is shown in FIG. 6.

The air injectors 220 are on-off type injectors driven by solenoid valves (not shown). For applications on the compressor rig 100, the injectors 220 are fed with a pressure source (not shown) supplying air at a maximum pressure of 80 PSI. Due to significant losses across the solenoid valves and between the valves and the pressure source, the injector back pressure reading may not represent an accurate indication of the actual velocity of the injected air on the rotor face 143. For example, using another hotwire anemometer (not shown), the maximum velocity of the injected air measured at a distance equivalent to the rotor-injector distance for 50 and 60 PSI injector back pressure are measured to be approximately 30.2 and 33.8 m/sec respectively. At the stall inception point, each injector 220 of this embodiment can add approximately 1.7% mass, 2.4% momentum, and 1.3% energy to the system when turned on continuously at 60 PSI injector back pressure. The bandwidth associated with the injectors is approximately 250 Hz at 50% duty cycle. The angle of injection, injector back pressure, the axial location of the injectors, and the radial location of the injectors can all be varied.

Figure 8A:
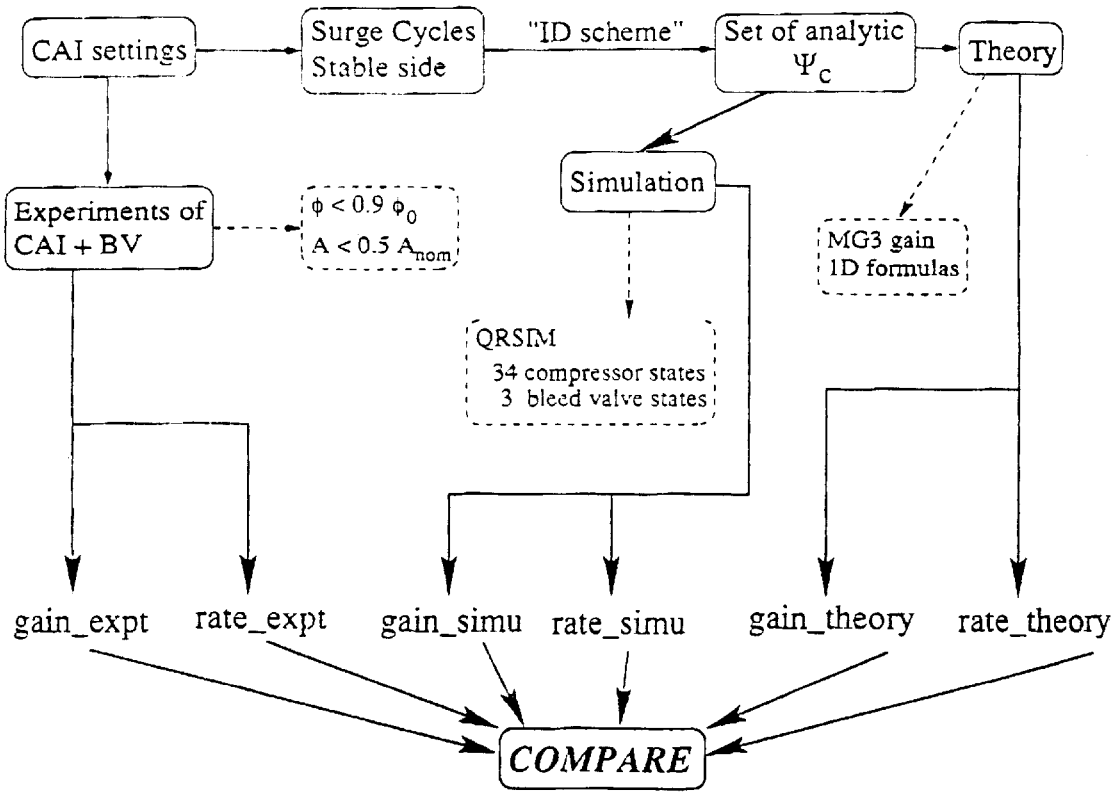
FIG. 8*a* is a flow chart summarization of the test procedure for comparison between theoretical, simulation and experimental determination of peak stabilization.
Figure 8B:
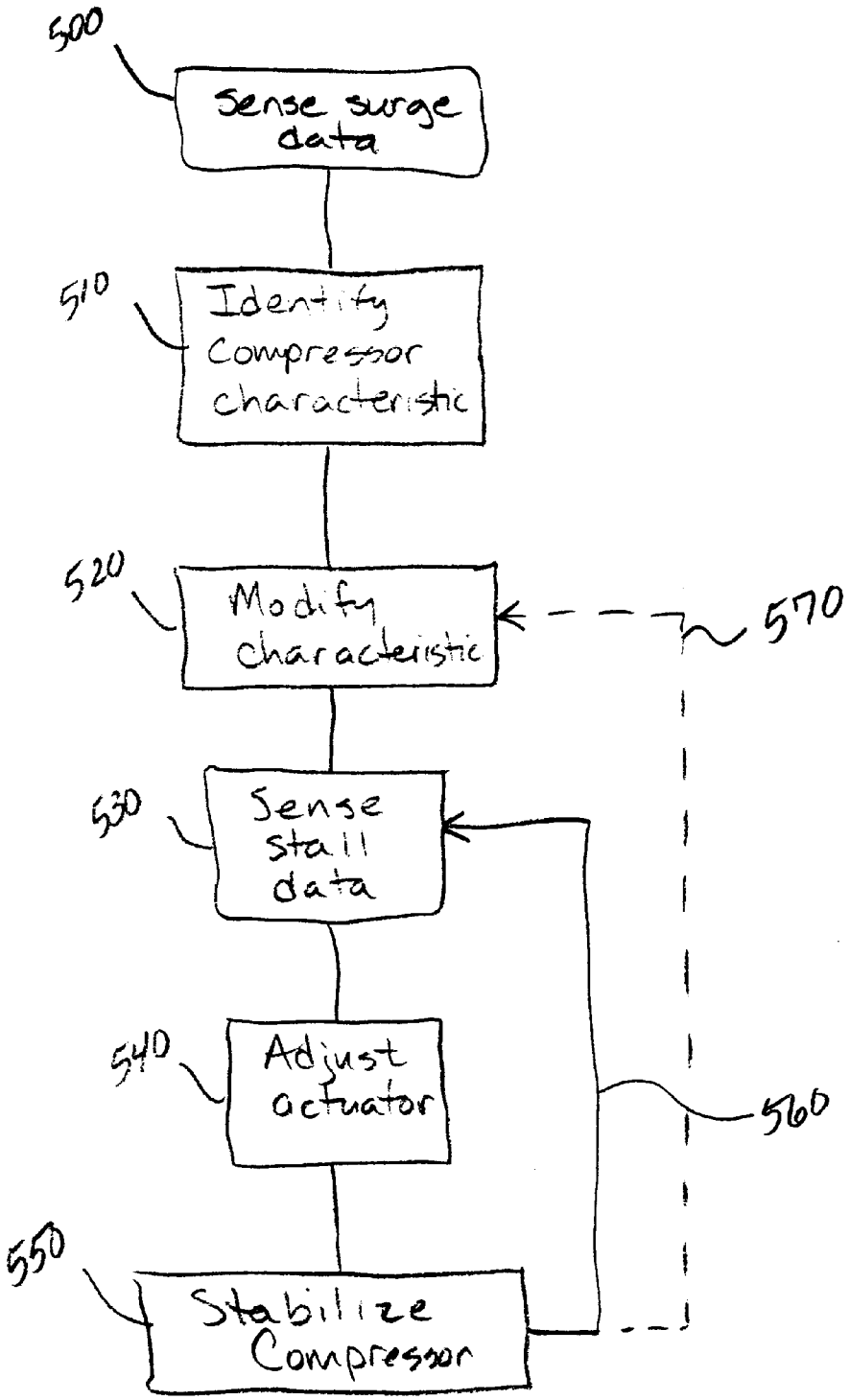
FIG. 8*b* is a flow chart of the method of the present invention for compressor stabilization.

Data acquisition and control of the compressor rig 100 is performed on a personal computer, running a method as shown generally in FIG. 8*b*. In the first step 500 of the method, the compressor system 100 senses surge data, including pressure and velocity. After transformation and filtering of the data, the compressor system 100 identifies, in step 510, the compressor characteristic that corresponds to the compressor based on the sensed surge data. Once the characteristic has been identified, the compressor system 100 modifies the compressor characteristic by, for example, switching on continuous air injection, as shown in step 520. Modification of the characteristic has the effect of lowering the bandwidth and rate limit of the actuator, thereby allowing the system to stabilize itself using an actuator with lower bandwidth and rate limit capabilities, such as a less expensive bleed valve. Although all of the steps are shown in a continuous manner, the above three steps, 500, 510 and 520, are performed off-line and prior to the remainder of the method.

In step 530, the system senses stall data, also including pressure and velocity. From this data, the system then adjusts the actuator, as shown in step 540. The adjusted actuator then stabilizes compressor instabilities, such as rotating stall and surge, shown in step 550. These three steps, 530, 540 and 550, are performed on-line in a closed-loop control routine as shown by loop 560. Although, as stated above, the previous three steps, 500, 510 and 520, are performed off-line and prior to stabilization, step 530, the compressor characteristic modification step, may also be performed on-line as part of the closed-loop control routine, as depicted by loop 570.

Actuator Gain and Rate at Peak Stabilization

Procedure

The amount of the effects of air injection on the system can be varied by modifying various geometrical characteristics of the injector location and configuration. The injector angle relative to the axial flow direction can be varied between 27° and 40° in the opposite direction of the rotor rotation. The back pressure of the injectors is varied between 40 to 60 psig, producing a total of 16 different scenarios and the nominal open-loop system without air injection. At the various injection settings, experiments are carried out to obtain the gain and rate values required for peak stabilization. The control law used was originally proposed by Liaw and Abed and has been validated by Eveker et al. For this study, peak stabilization is achieved if the conditions are met:

$$\phi \geqq 0.9\phi^*$$

$$A \leqq 0.5A_{nom}$$

where $\phi$ is the axial velocity and A is the amplitude of the first Fourier mode, $\phi^*$ is the flow at stall inception, and $A_{nom}$ is the amplitude of fully developed stall without bleed valve control. $\phi^*$ is taken experimentally at the stall inception point for each of the injection settings under consideration. A function is written to increment the gain until the conditions of peak stabilization are met. An analogous function is written for the rate. The gain/rate required for peak stabilization is then obtained by first setting the system operating point to stable but near-stall inception. With the rate/gain fixed, injection and the controller is then activated with the gain/rate set to zero. The load of the compressor is then increased by changing the throttle setting until a nominally unstable operating point is reached. The gain/rate incrementing function then increments the variable of interest until peak stabilization is achieved. The gain and rate obtained from the experiments are referred to as $K_{expt}$ and $R_{expt}$ respectively.

Figure 7:
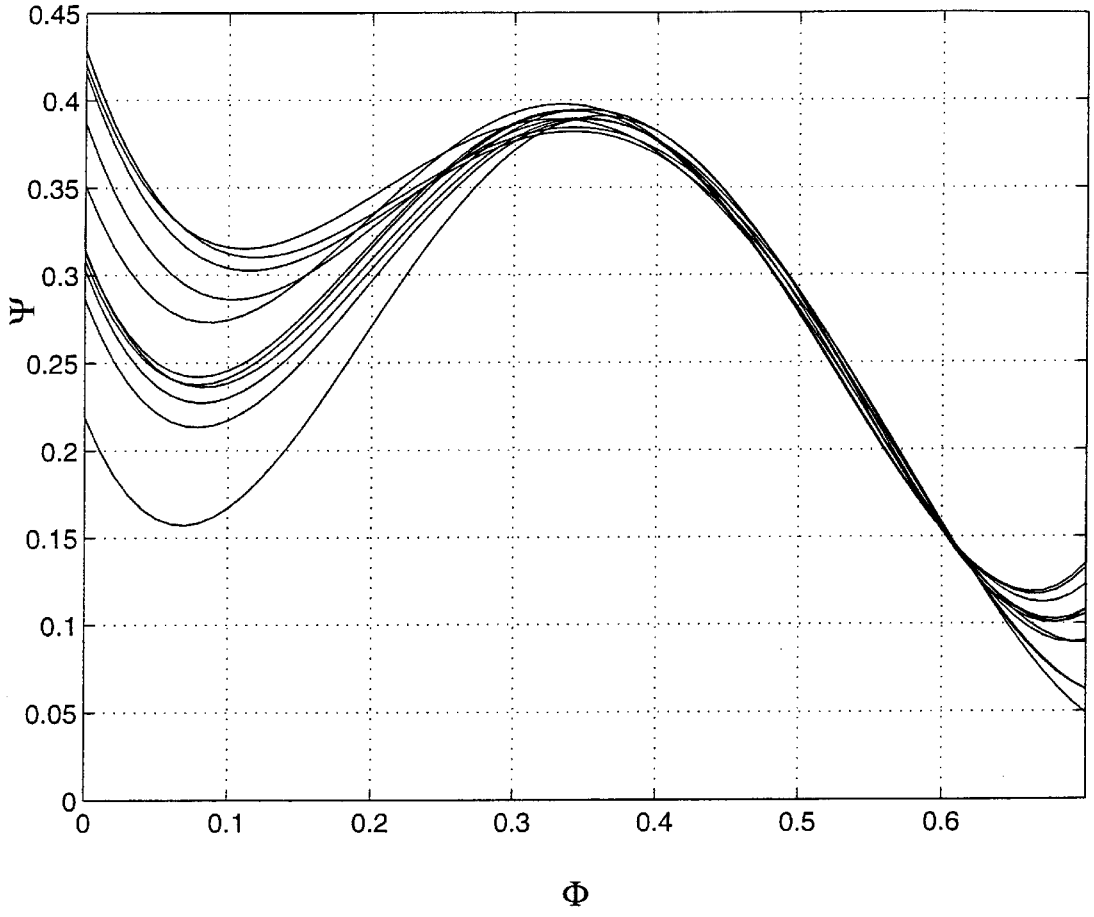
FIG. 7 is graph of fitted compressor characteristics for the eleven tested combinations of injector angle and back pressure.

Among the 17 injection settings, peak stabilization is achieved in 11 cases and the nominally stable side of the compressor characteristic is experimentally recorded at each of the 11 settings. The unstable sides for each of these cases are identified by using surge cycle data with an algorithm proposed by Behnken. For this study, a fourth order polynomial is used to approximate the piecewise continuous curve for each case. FIG. 7 shows the fitted compressor characteristics. These polynomial compressor characteristics are then used with realistic values of various parameters (e.g. noise level in system) in analytical relations and in simulations that estimate the gain and rate requirements on the bleed valve for stabilization. A summary of the procedures is shown in FIG. 8*a*.

Estimation of Uncertainty

There are two main factors affecting the precision of the results, namely, the unsteadiness in the fluid system and human-induced imprecision. The unsteadiness of the fluid system is present due to the nature of the system and imperfections during the construction of the experiment such as circumferential non-uniformities at the inlet. It adds to the level of imprecision in the compressor characteristic identification part of the analysis, which in turns appears in the theoretical and simulation estimations. The human-induced factor includes the amount of uncertainty that is injected into the analysis when the experimentalist manually changes the injection setting from one to the next. This particular factor adds uncertainty to all levels, ranging from the confidence level of the compressor characteristic identification to the experimentally-obtained gain and rate values. Therefore, an estimate of the size of uncertainty is desired to complement and contrast the results.

Figure 9:
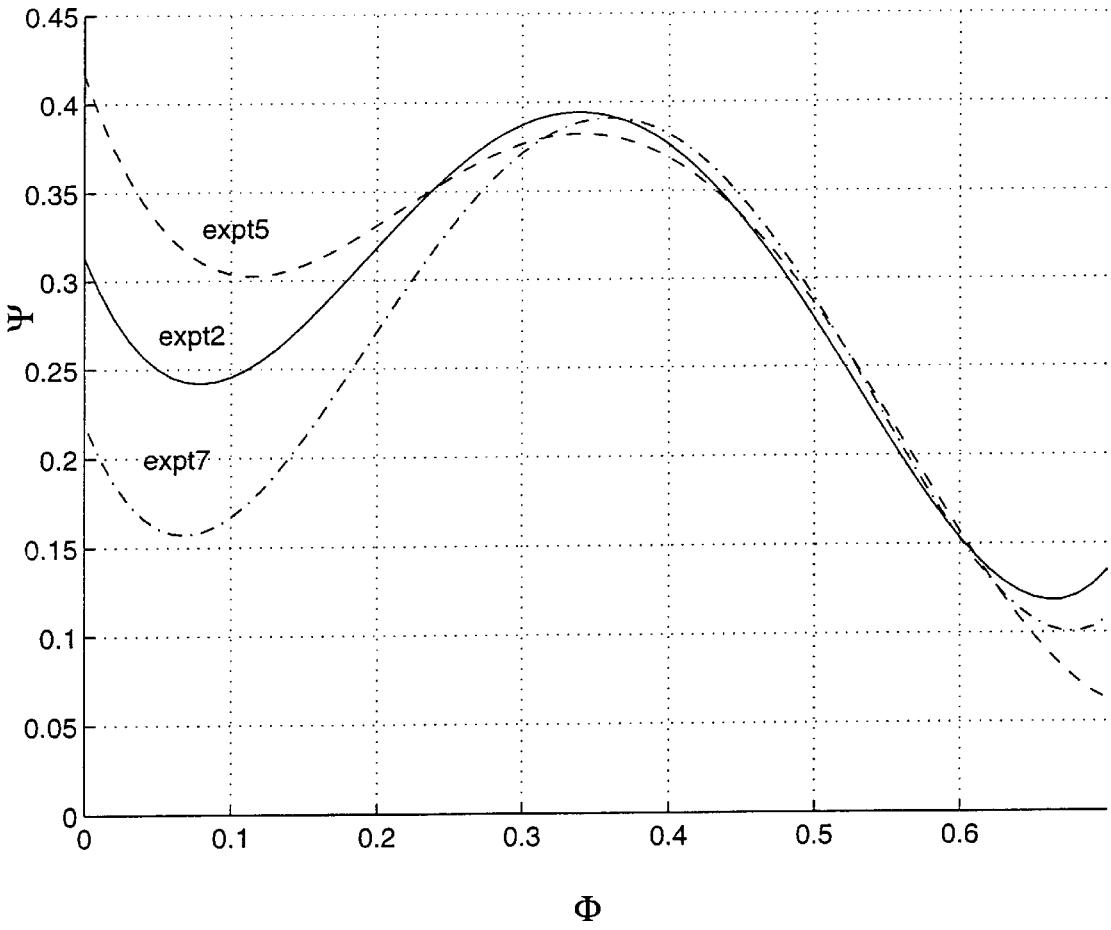
FIG. 9 is a graph of three identified compressor characteristics at three different continuous air injection settings.

To determine the level of uncertainty, ten experiments with the injection setting manually changed and returned to the appropriate values are carried out to estimate the amount of uncertainty the experimentalist contributes. The $K_{theory}$ and $R1_{theory}$ and the error bars for this case are computed. To obtain further insights about the level of confidence of the data, error bars for 3 of the 11 points are obtained, namely, experiment number 2 (expt2), 5 (expt5), and 7 (expt7). The identified compressor characteristics associated with these 3 points are shown in FIG. 9.

Similar to the test of human-induced uncertainty, ten sets of surge cycles are taken for each case and error bars on $K_{theory}$, $R1_{theory}$, and $R2_{theory}$ are obtained. Ten stabilization experiments are also run on each of the three cases to obtain the error bars on $K_{expt}$ and $R_{expt}$.

Actuator Rate and Gain Results

Figure 10:
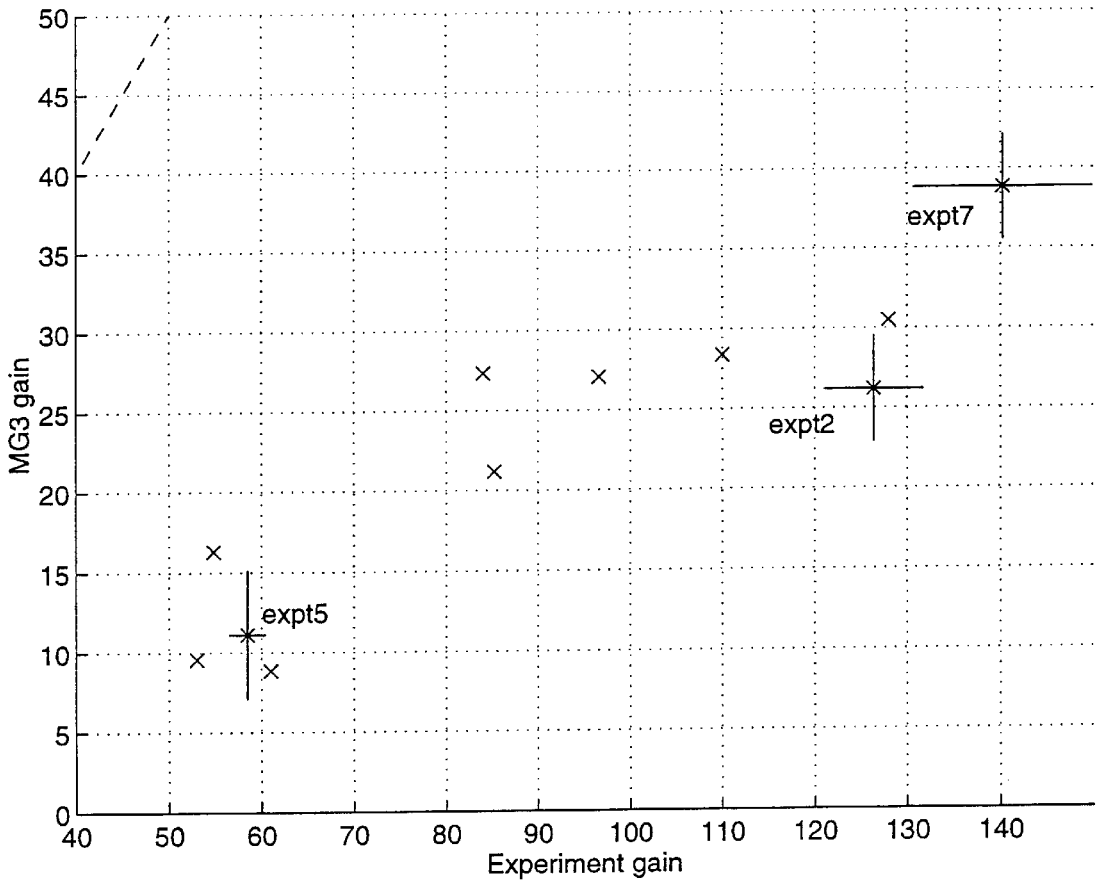
FIG. 10 is a graph of a comparison of theoretically predicted gain and experimental gain required for stabilization of stall.

The values of the gain predicted by the theory are plotted against the gains obtained on the experiments in FIG. 10. In all of the plots presented in this section, the dashed line represents the one-to-one line between the theoretically and experimentally obtained gain values. As shown in FIG. 10, the $K_{theory}$ estimates are not quantitatively reliable but do present the qualitative monotonic trend as expected. The main factor contributing to the quantitative disagreement between $K_{theory}$ and the experiment is the lack of actuator dynamics in the derivation of the analytical expression. The bleed valve is assumed to be ideal with infinite bandwidth and magnitude saturation in the analysis while it is present in the experiments.

Figure 11:
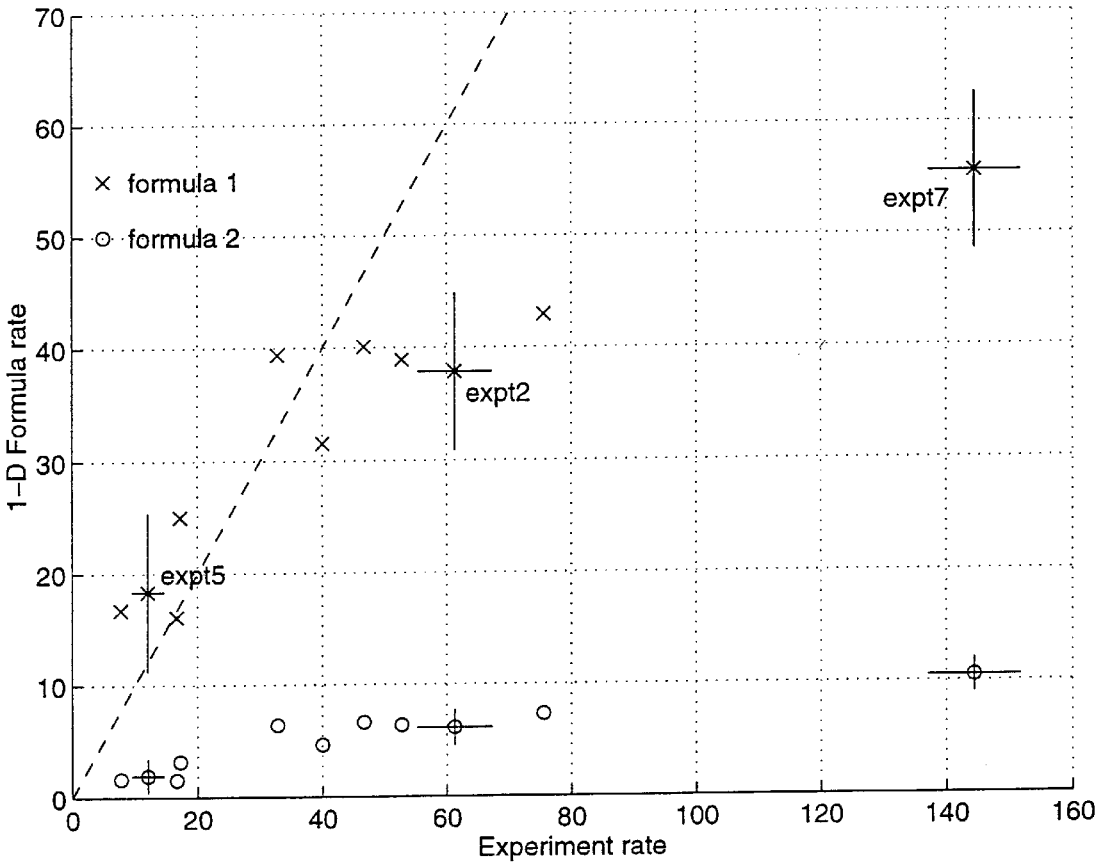
FIG. 11 is a graph of a comparison of theoretically predicted rate and experimental rate required for stabilization of stall.

The values of the rate predicted by the two analytical relations, $R1_{theory}$ and $R2_{theory}$ are plotted against the rates obtained on the experiments in FIG. 11. This figure shows that $R1_{theory}$ predicts the rate requirement more accurately than $R2_{theory}$. The main difference between the two expressions originates from the different approximations to the solution of the one-dimensional approximation to the Moore-Greitzer equations. Despite their quantitative differences, a monotonic trend similar to that observed in the theoretical gain comparison is again displayed.

Figure 12:
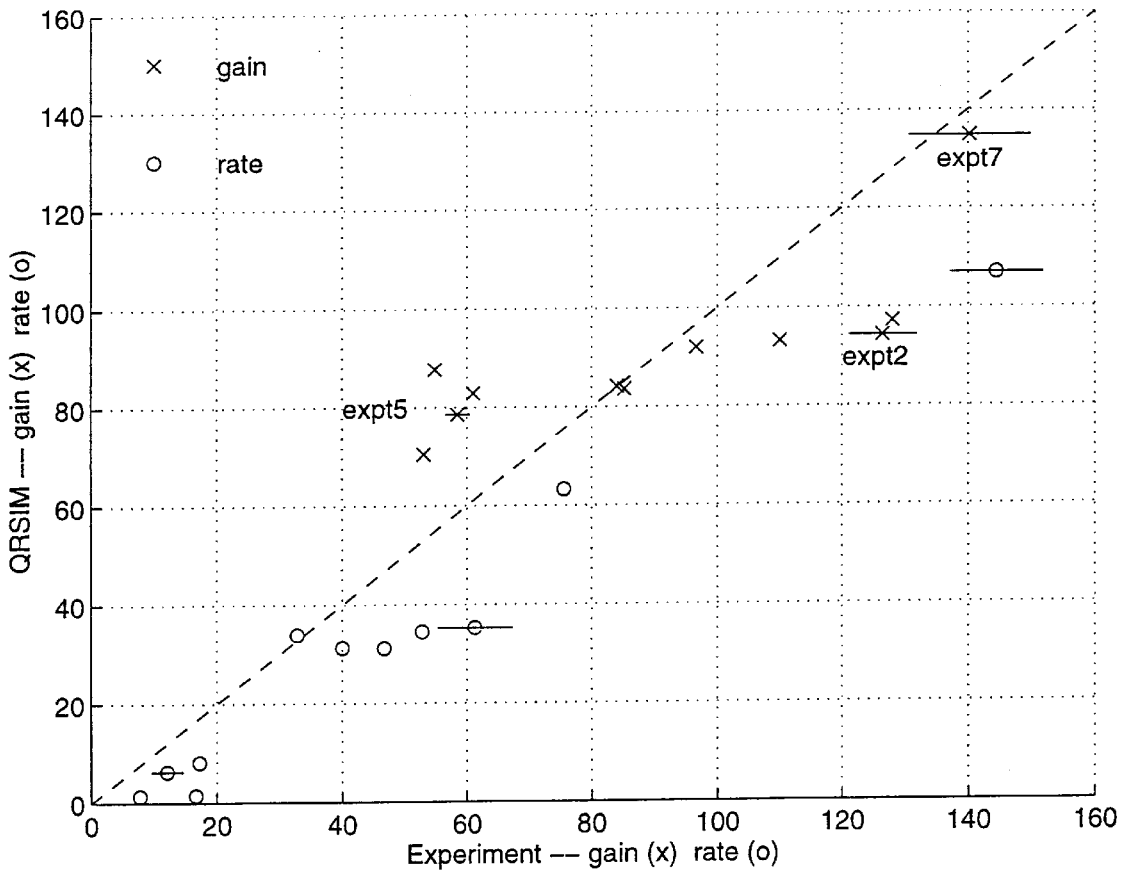
FIG. 12 is a graph of a comparison of simulation predicted gain and rate and experimental gain and rate required for stabilization of stall.

The values of gain and rate predicted by simulations are plotted against the experimental values in FIG. 12. The gain and rate estimates of the simulations match with the experimentally-obtained counterpart more closely than the theoretical predictions. However, a linear fit of $K_{simu}$ to $K_{expt}$ gives a non-zero offset. A possible explanation for this phenomenon is that the only difference in the 11 simulations are the compressor characteristics and the effective length parameter in the model $l_c$. The effects of continuous air injection on the system in certain cases may require modifying more parameters in order to accurate capture the reality. A more careful identification of the system at each point should present a more reliable simulation.

The experimental rate values range from below 10 Hz to approximately 145 Hz (rotor frequency is 100 Hz and stall frequency is 65 Hz) with different amounts of compressor characteristic actuation. It can be seen from FIG. 7 that the shape as well as the peak of the compressor characteristics are different from one another. Continuous air injection on the Caltech rig shifts the peak of $\Psi_c(\phi)$ which translates into a different stall inception point, while the change of the shape can be captured by the quantities $\Psi_c''(\phi)$ and $\Psi_c'''(\phi)$. At high flow coefficient, where operation is stable, the effects of air injection are much less than that at low flow coefficient, where operation is unstable. As a result, the effects of compressor characteristic actuation can only be captured when both the stable and unstable parts of $\Psi_c(\phi)$ are considered. Mansoux et al. investigated the region of attraction of the stall inception point in the distributed model. One of the conclusions drawn from their analysis is a dependence on the shape of the compressor characteristic. From the $K_{theory}$ expression, a similar observation can be made based on the form of the formula:

$$K_{THEORY} = -\frac{\phi^*\Psi_C(\phi)}{8\gamma^*\psi^*\Psi_c(\phi)} - \frac{\gamma^*\Psi_c(\phi)}{8\psi^*}$$

Figure 13A:
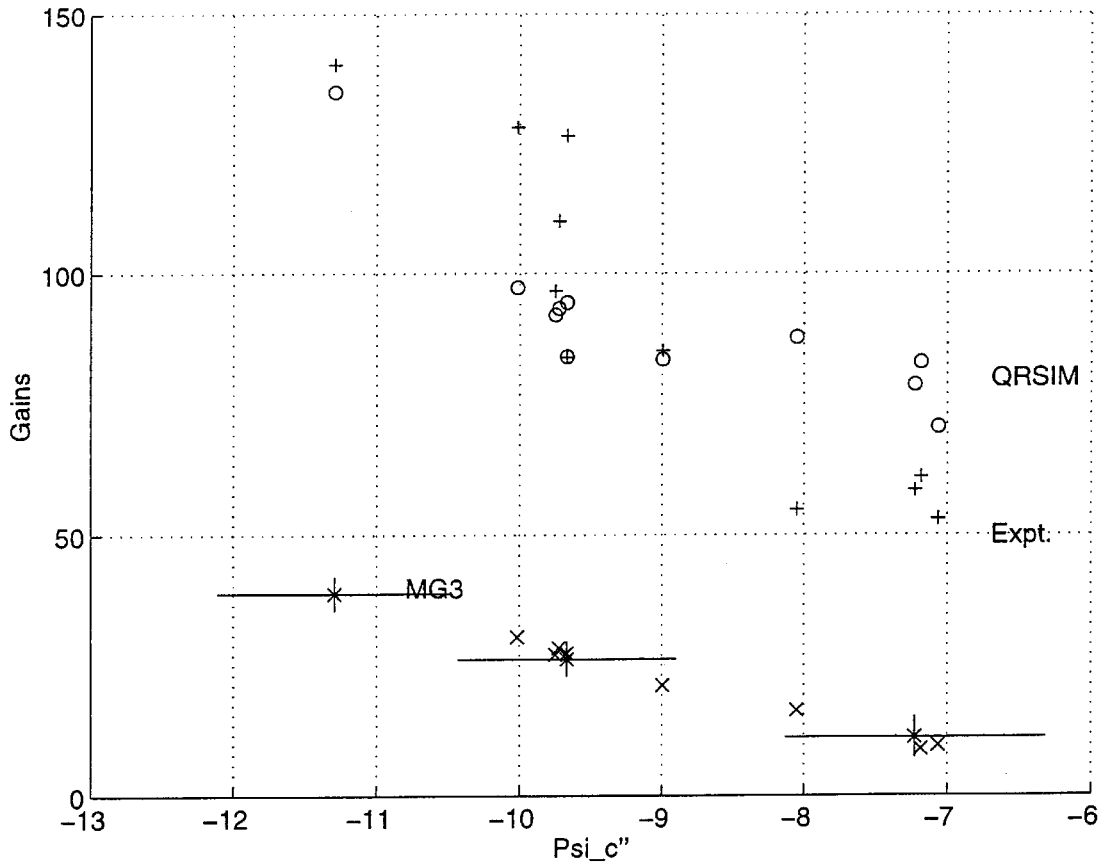
FIG. 13*a* is a graph showing the dependence of $K_{theory}$, $K_{simu}$, and $K_{expt}$ on $\Psi_c''(\phi)$.
Figure 13B:
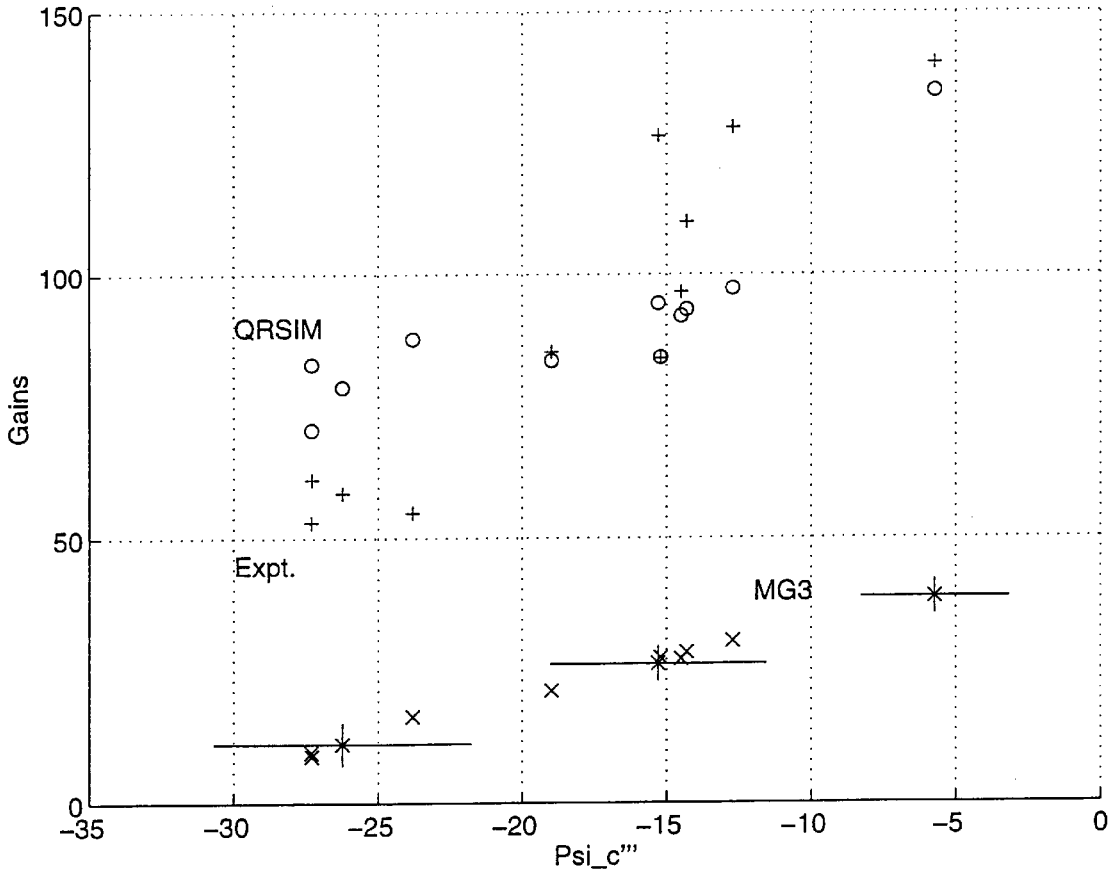
FIG. 13*b* is a graph showing the dependence of $K_{theory}$, $K_{simu}$, and $K_{expt}$ on $\Psi_c'''(\phi)$.
Figure 14A:
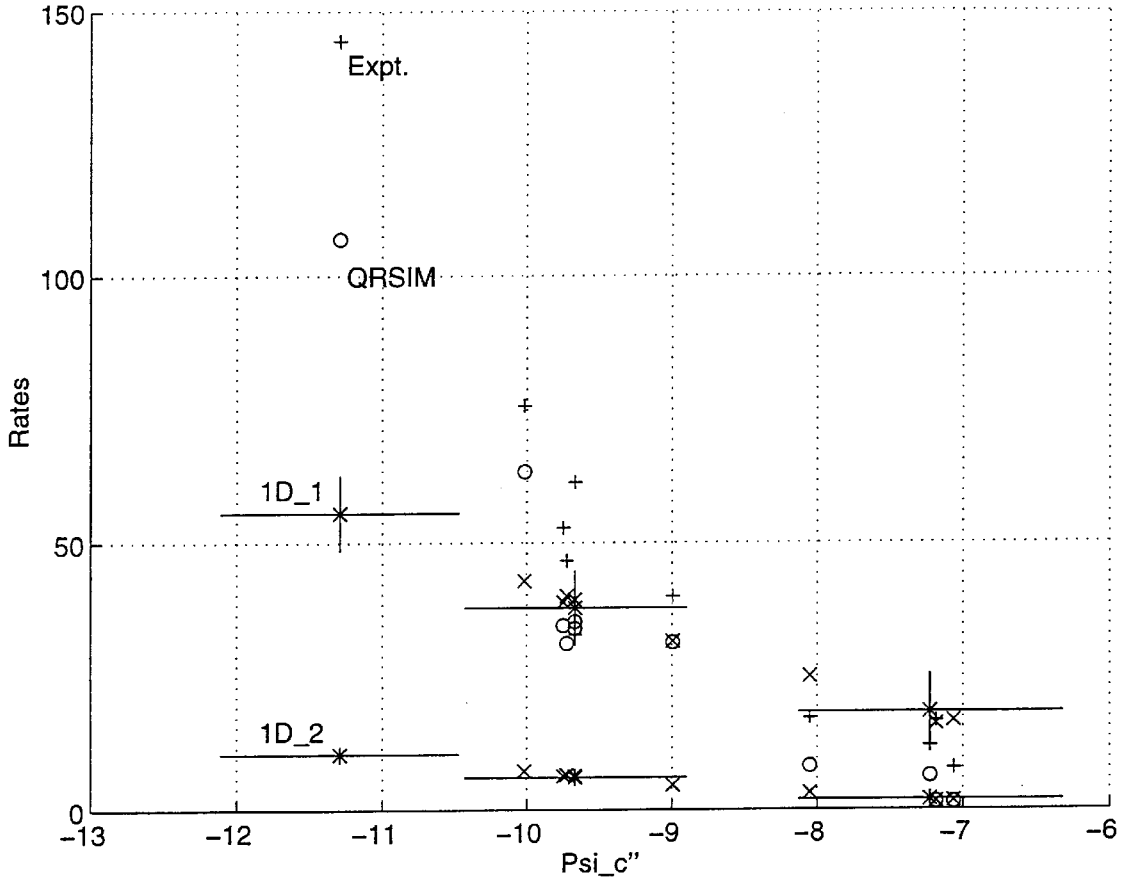
FIG. 14*a* is a graph showing the dependence of $R_{theory}$, $R_{simu}$, and $R_{expt}$ on $\Psi_c''(\phi)$.
Figure 14B:
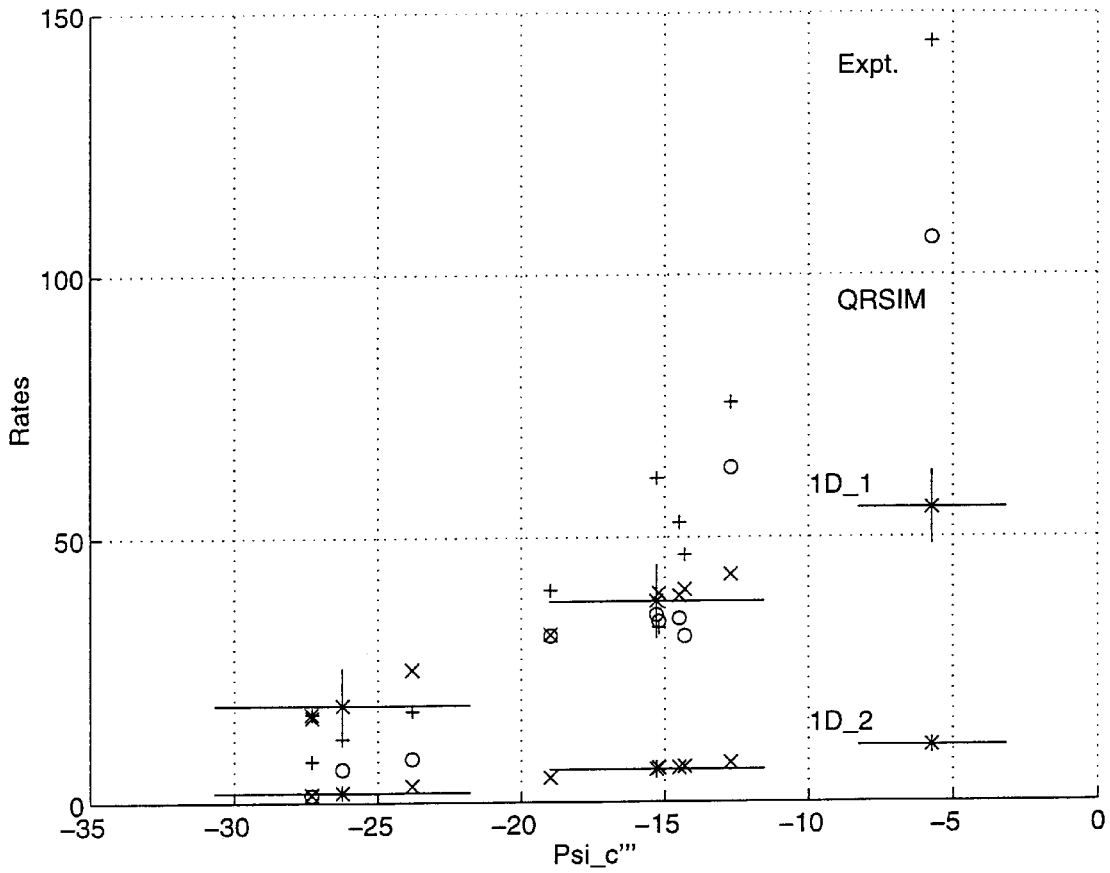
FIG. 14*b* is a graph showing the dependence of $R_{theory}$, $R_{simu}$, and $R_{expt}$ on $\Psi_c'''(\phi)$.

It can be seen from the formula that $K_{theory}$ depends linearly on $\Psi_c'''(\phi)$ and nonlinearly on $\Psi_c''(\phi)$. A similar conclusion can be drawn for $R1_{theory}$ and $R2_{theory}$ with a closer examination of the expressions. The values of the gains from the theory, simulations, and experiments are plotted against $\Psi_c''(\phi)$ in FIG. 13*a*, and $\Psi_c'''(\phi)$ in FIG. 13*b*. The analogous plots for the rate expressions are shown in FIGS. 14*a* and 14*b*. It can be seen from both plots that the gain and rate values obtained from theory, simulations, and experiments share the same trend on their dependence on $\Psi_c''(\phi)$ and $\Psi_c'''(\phi)$. Since the values of the derivatives cannot be obtained without identifying the unstable part of $\Psi_c(\phi)$, the shape of the unstable part of $\Psi(\phi)$ contains information for the gain and rate requirements of bleed valve control of stall.

Rotating Stall and Surge Control

Figure 15:
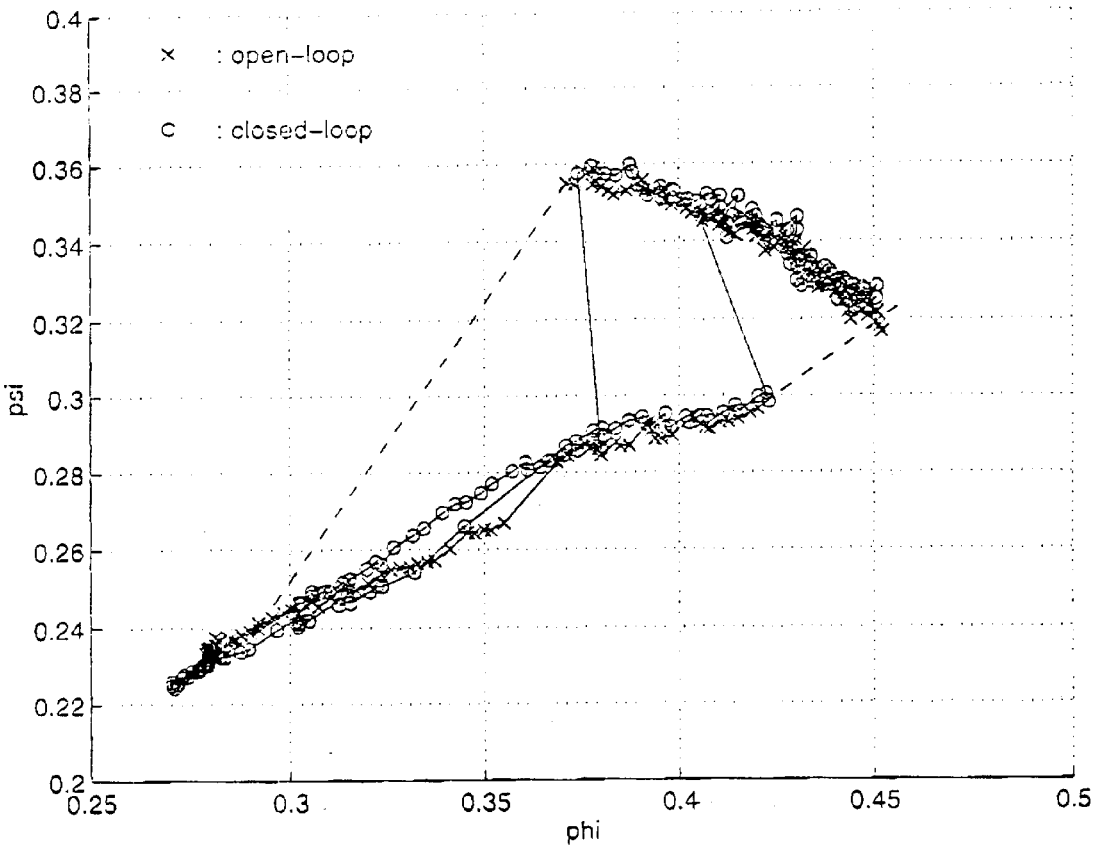
FIG. 15 is a graph of an implementation of the Liaw-Abed control law using a bleed valve only for control of surge and stall.

Implementation of the Liaw-Abed control law was attempted initially using only the (high speed) 1-D bleed valve. The throttle of the system is used to carry the system through a range of flow coefficients to generate a plot of closed-loop operation. FIG. 15 shows the results of the experiment. At the stall inception point, the disturbance starts to grow and the bleed valve opens in an attempt to suppress the stall event. However, due to bandwidth and magnitude limits, the system goes unstable and gets stuck at the lower branch of the hysteresis loop. This phenomenon is due primarily to the fast stall cell growth rate relative to the bandwidth and rate limit of the bleed valve.

At certain injector angles and locations, different injector back-pressures can reduce the size of the open-loop hysteresis loop by different amounts on the Caltech rig. Continuous air injection is used in combination with the bleed valve in the second attempt of the implementation of Liaw-Abed in the investigation of possible reduction of bandwidth and magnitude requirements for bleed valve controls of rotating stall via changing the compressor behavior.

Figure 16A:
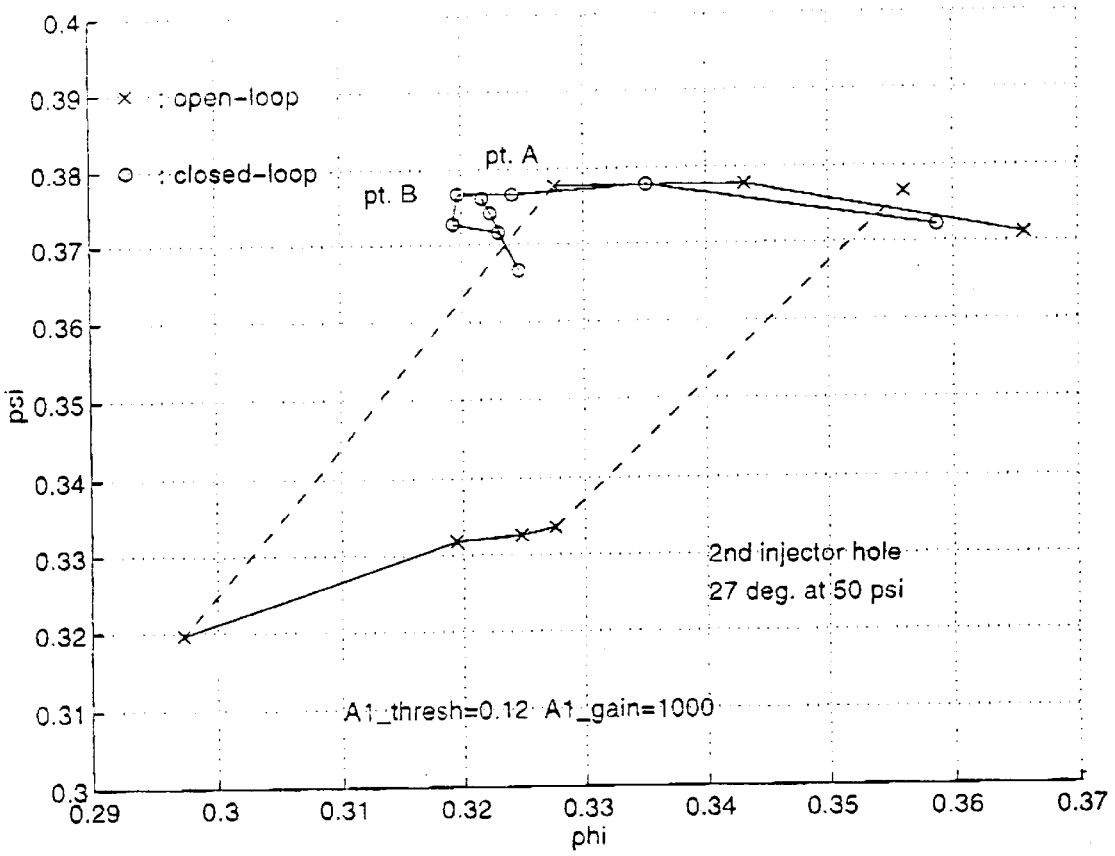
FIG. 16*a* is a graph showing open- and closed-loop compressor characteristics for Liaw-Abed control with bleed valve and continuous air injection at 50 psi injector back pressure.
Figure 16B:
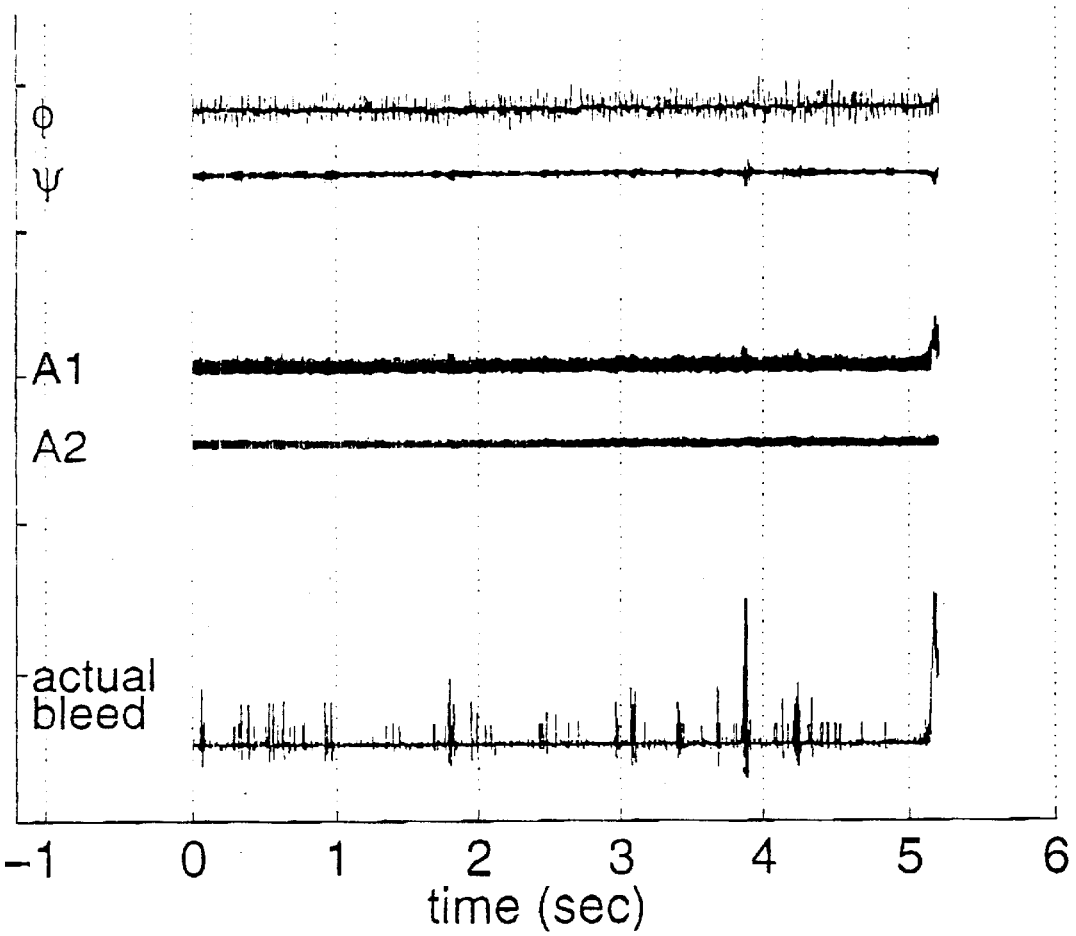
FIG. 16*b* is a time trace at point A for the graph in FIG. 16*a*.
Figure 16C:
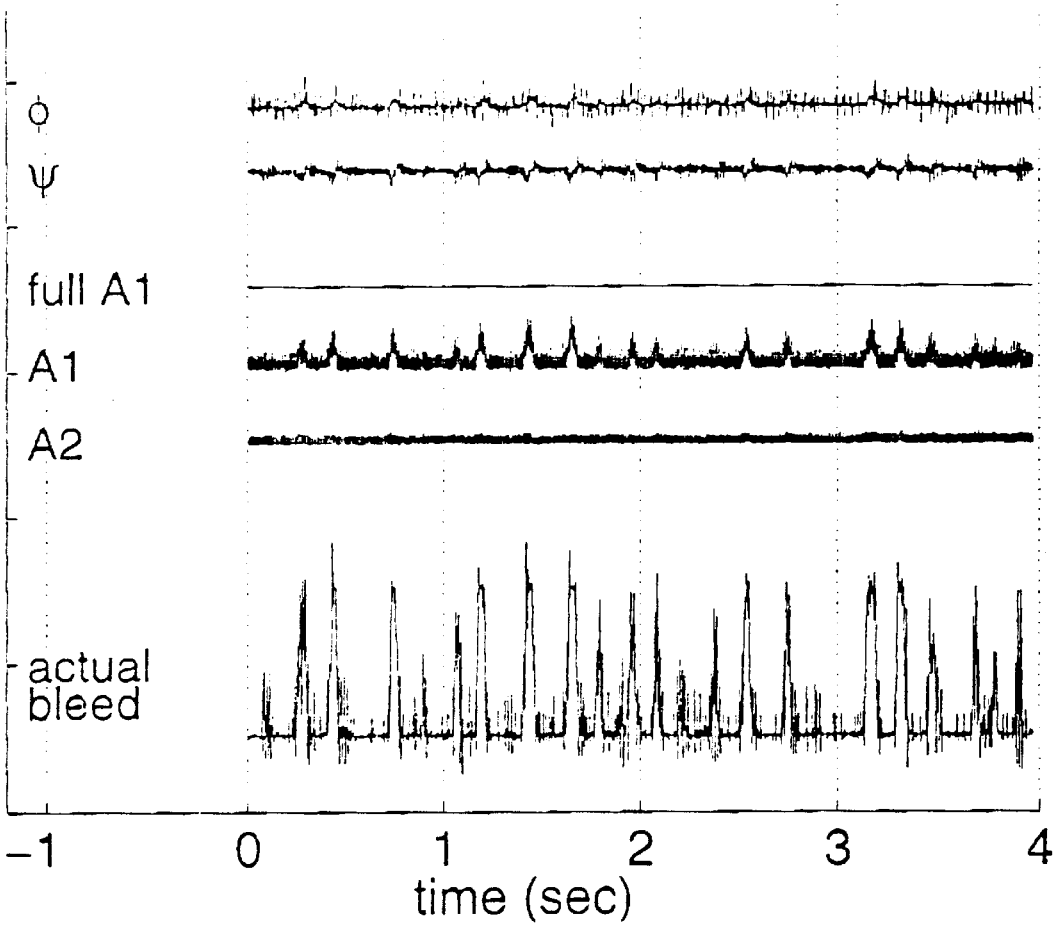
FIG. 16*c* is a time trace at point B for the graph in FIG. 16*a*.

One such attempts is performed by setting the air injector angle at 27° with positive angles implying counter-compressor-rotation and 50 PSI injector back pressure. FIG. 16*a* shows the open- and closed-loop compressor characteristic, and the time traces of the relevant quantities at points A and B are shown in FIGS. 16*b* and 16*c*, respectively, on the compressor characteristic plot, which are stalled points in the open-loop. By comparing FIG. 15 and FIG. 16*a*, it can be seen that the difference between the values of the flow at the point of unstall and the point of stall inception is less in the case with air injection than in the case without. It can also be seen from the time traces that the bleed controller is continuously rejecting the disturbances in the system, and the flow and pressure signals are relatively constant.

Figure 17A:
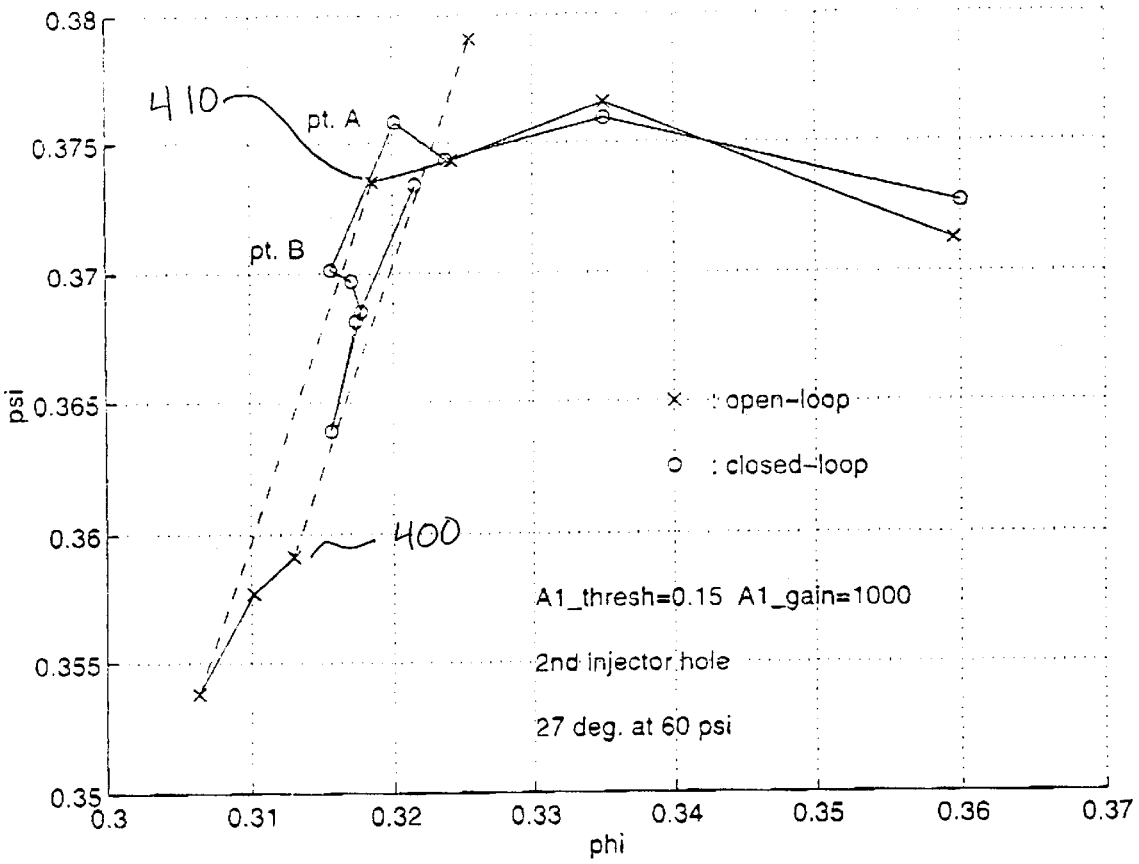
FIG. 17*a* is a graph showing open- and closed-loop compressor characteristics for Liaw-Abed control with bleed valve and continuous air injection at 60 psi injector back pressure.
Figure 17B:
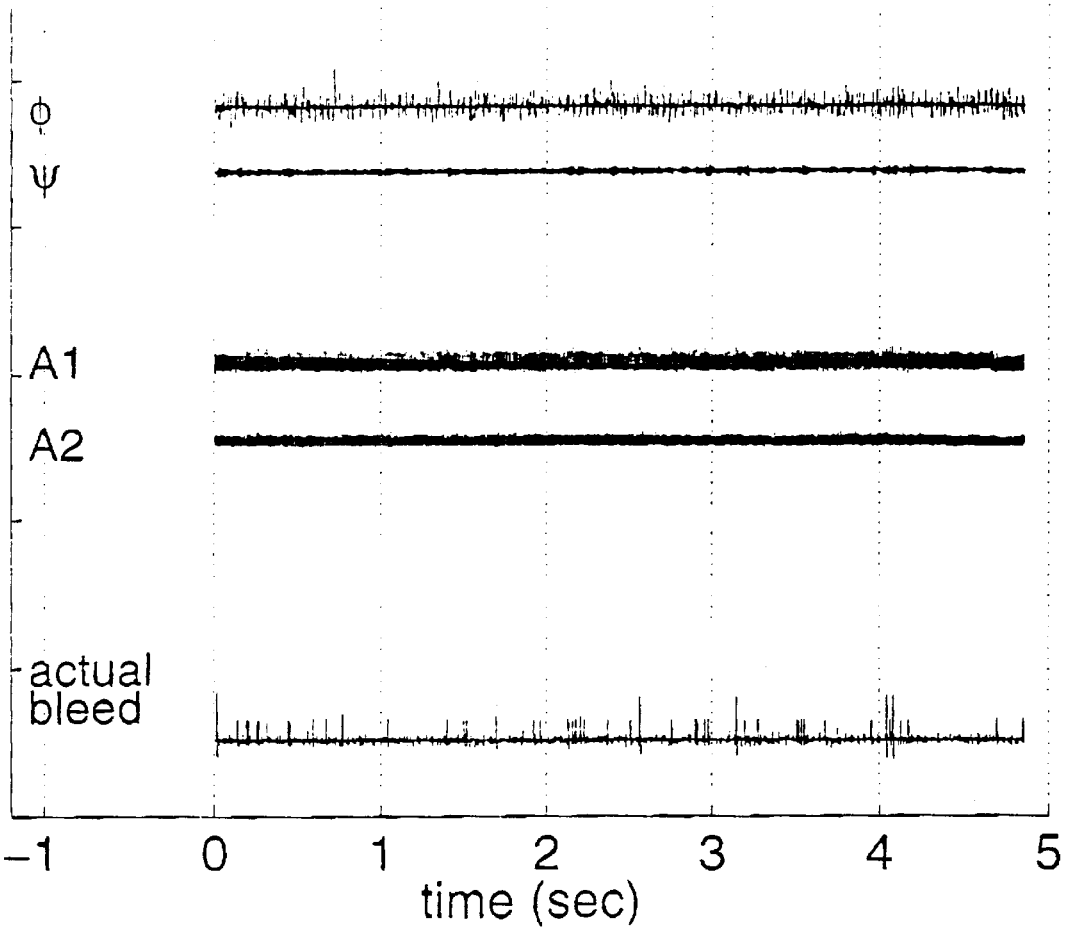
FIG. 17*b* is a time trace at point A for the graph in FIG. 17*a*.
Figure 17C:
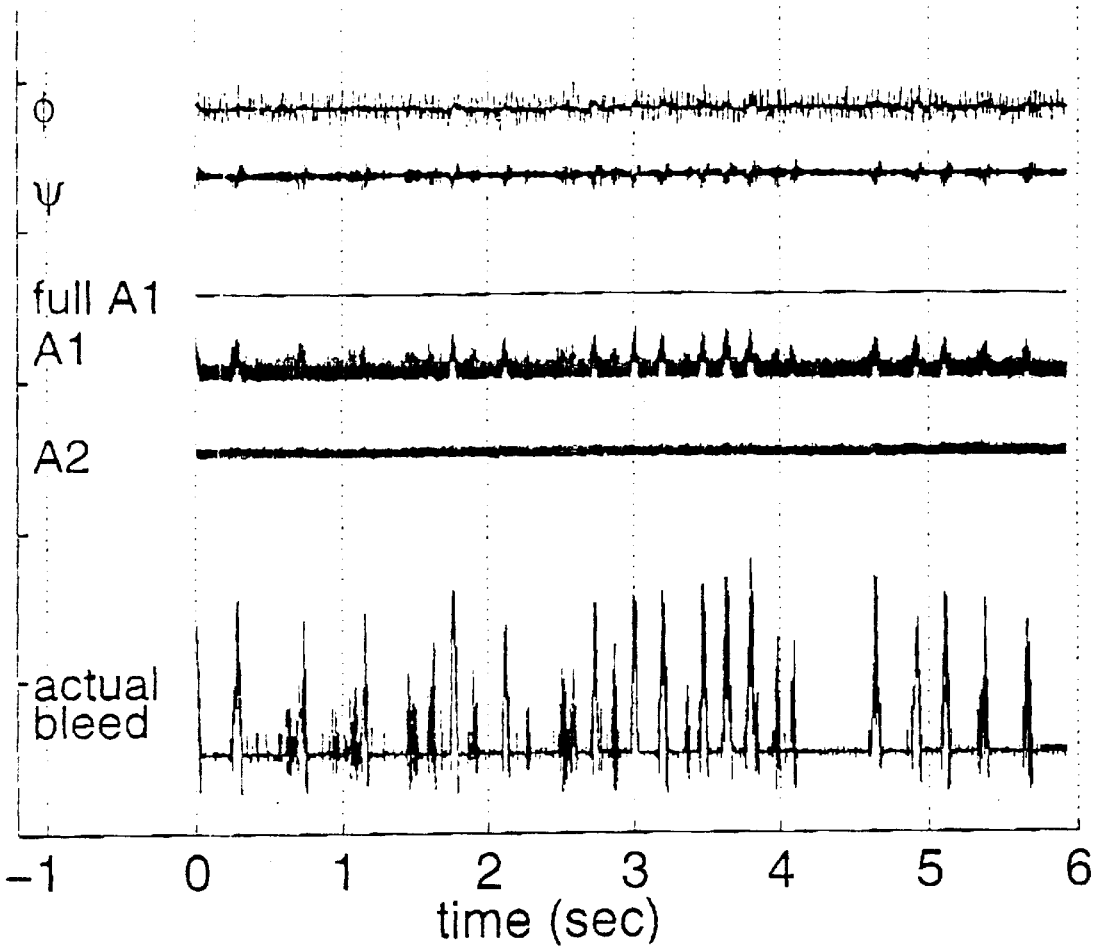
FIG. 17*c* is a time trace at point B for the graph in FIG. 17*a*.

Another attempt using the bleed valve with continuous air injection is made by changing the injector back pressure to 60 PSI. FIG. 17*a* shows the open- and closed-loop compressor characteristic and the time traces of the relevant quantities at points A and B are shown in FIGS. 17*b* and 17*c*, respectively, on the compressor characteristic plot, which are again stalled points in the open-loop. Similar to the case of 50 PSI injector back pressure, it can be seen from the time traces that the bleed controller is continuously rejecting the disturbances in the system, and the flow and pressure signals are relatively constant.

Figure 18:
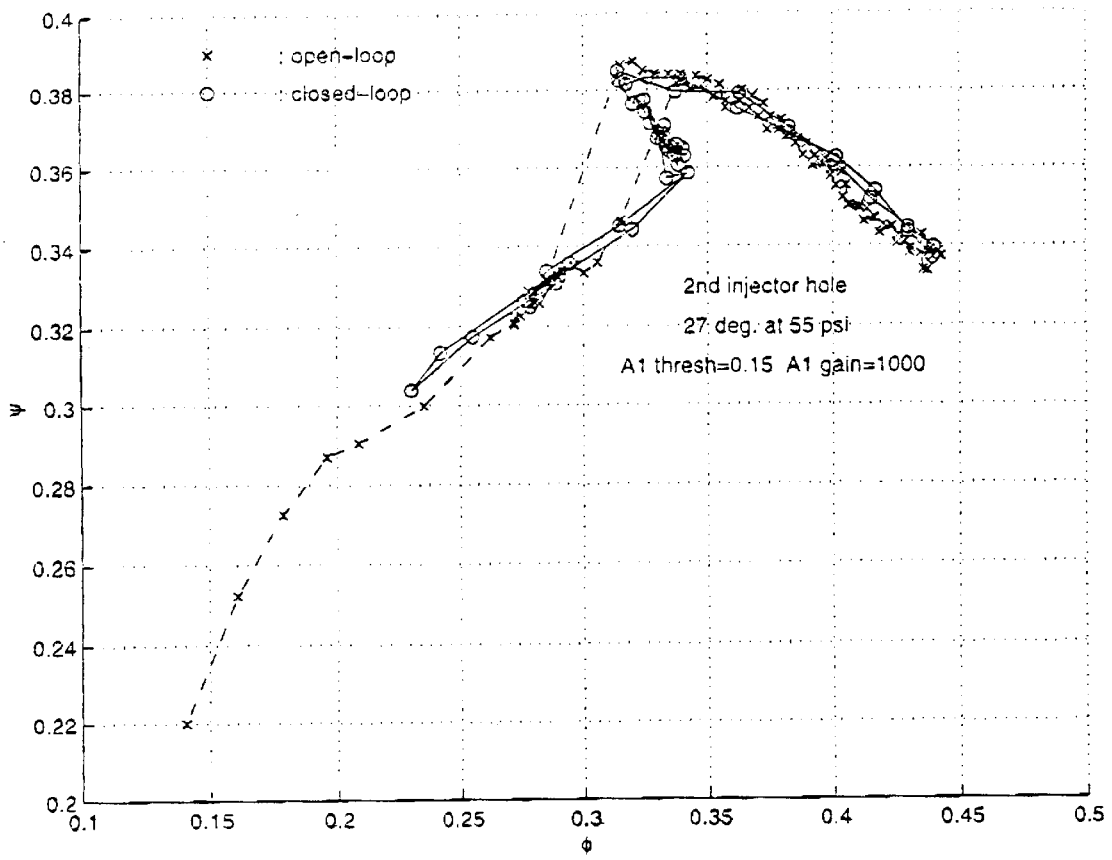
FIG. 18 is a graph showing open- and closed-loop behavior of the compressor on the $\phi$-$\psi$ plane for control with bleed valve and continuous air injection at 55 psi injector back pressure.
Figure 19:
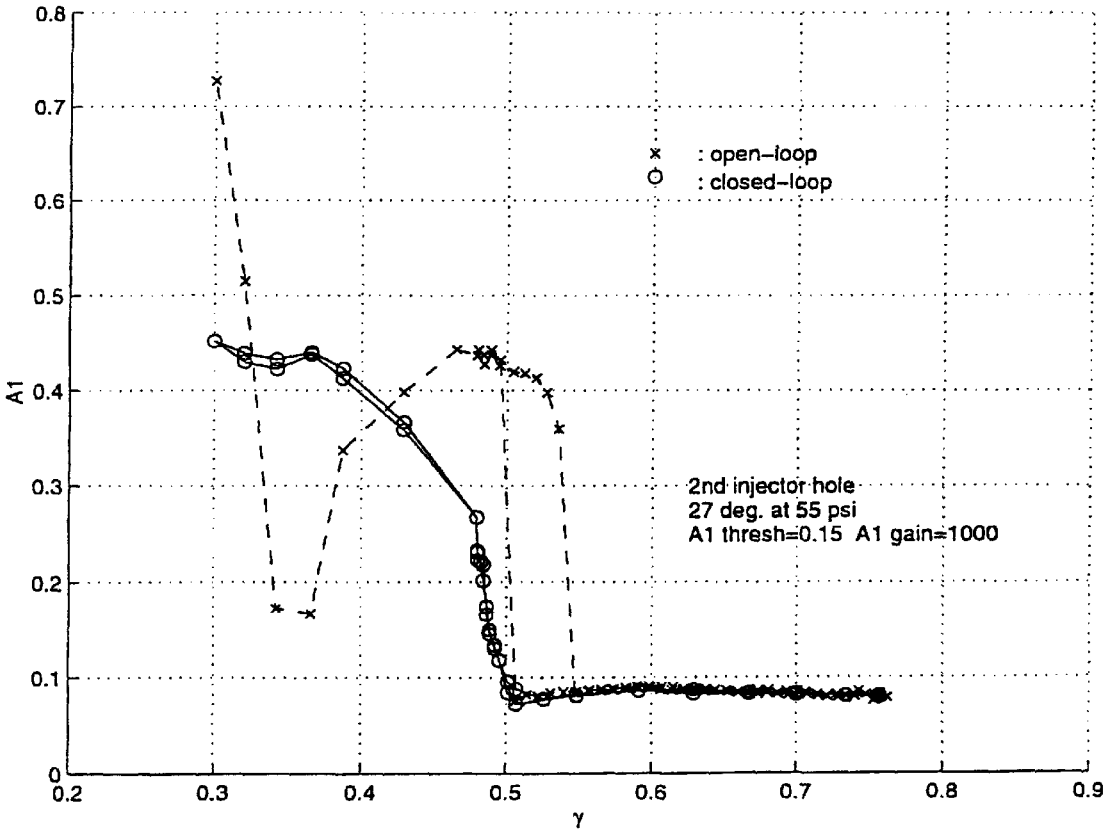
FIG. 19 is a graph showing open- and closed-loop behavior of the compressor on the $\gamma$-J plane for control with bleed valve and continuous air injection at 55 psi injector back pressure.

A more detailed experiment is carried out with the injector back pressure set at 55 PSI. FIGS. 18 and 19 show the open- and closed-loop behavior of the system in the $\phi$-$\psi$ plane and the $\gamma$-J plane respectively. The closed-loop behavior shows no hysteresis loop on FIGS. 18 and 19, as expected from the theory. As FIG. 18 shows, after the bleed valve saturates, the system returns to the original stalled equilibria. FIG. 19 is expected to show the same observation in the $\gamma$-J plane. The mismatch at low values of $\gamma$ is due to the formation of the second mode of stall in the open-loop case. For the open-loop system with continuous air injection, the second mode of rotating stall forms at a value of $\gamma$ smaller than that for the formation of the first mode. At $\gamma$=0.45 on FIG. 19, the second mode forms and becomes dominant, and the amplitude of the first mode is decreased. Further decrease in $\gamma$ leads to a further reduction in the amplitude of the first mode. At around $\gamma$=0.33, the throttle is almost fully closed and the first mode becomes dominant again. In the closed-loop case, this phenomenon is not observed since the high speed bleed valve saturates and remains open. As a result, the main flow level is not low enough for the second mode of rotating stall to form.

Figure 20A:
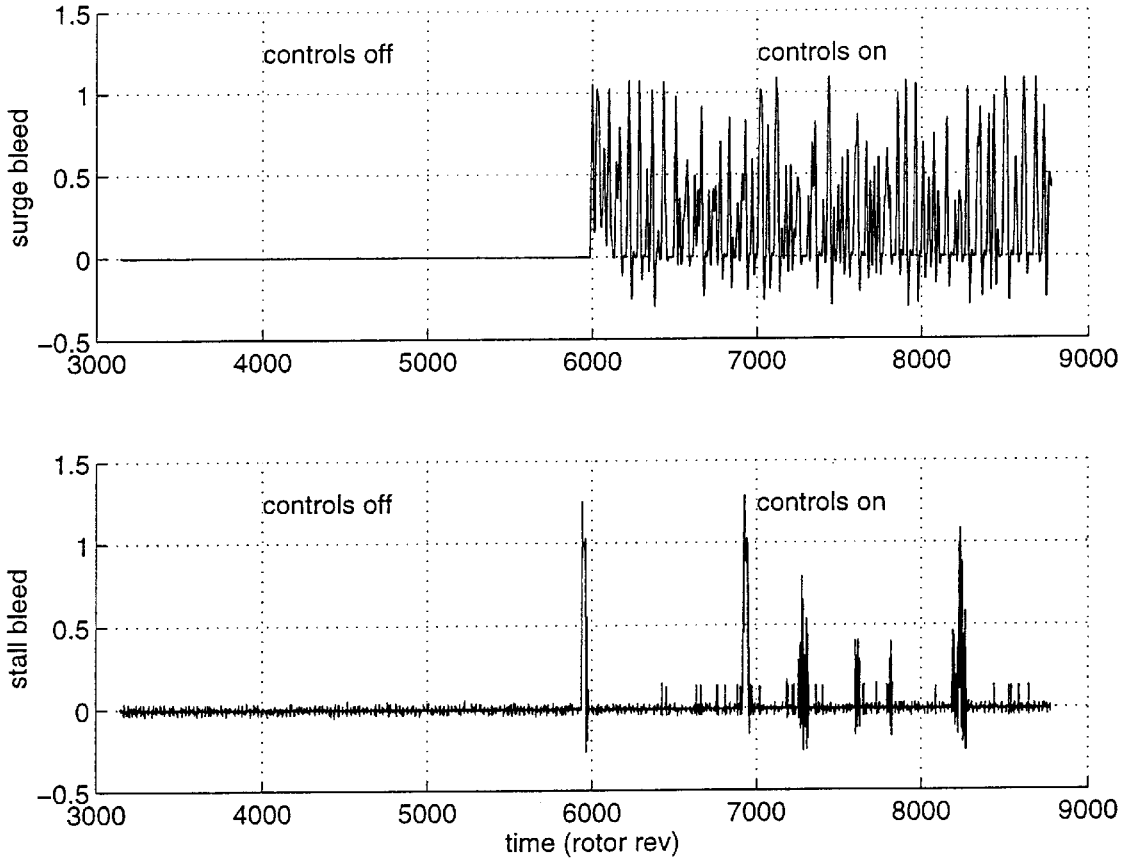
FIG. 20*a* shows time traces of both surge bleed and stall bleed with continuous air injection; control initially off and turned on at approximately 6000 rotor revolutions.
Figure 20B:
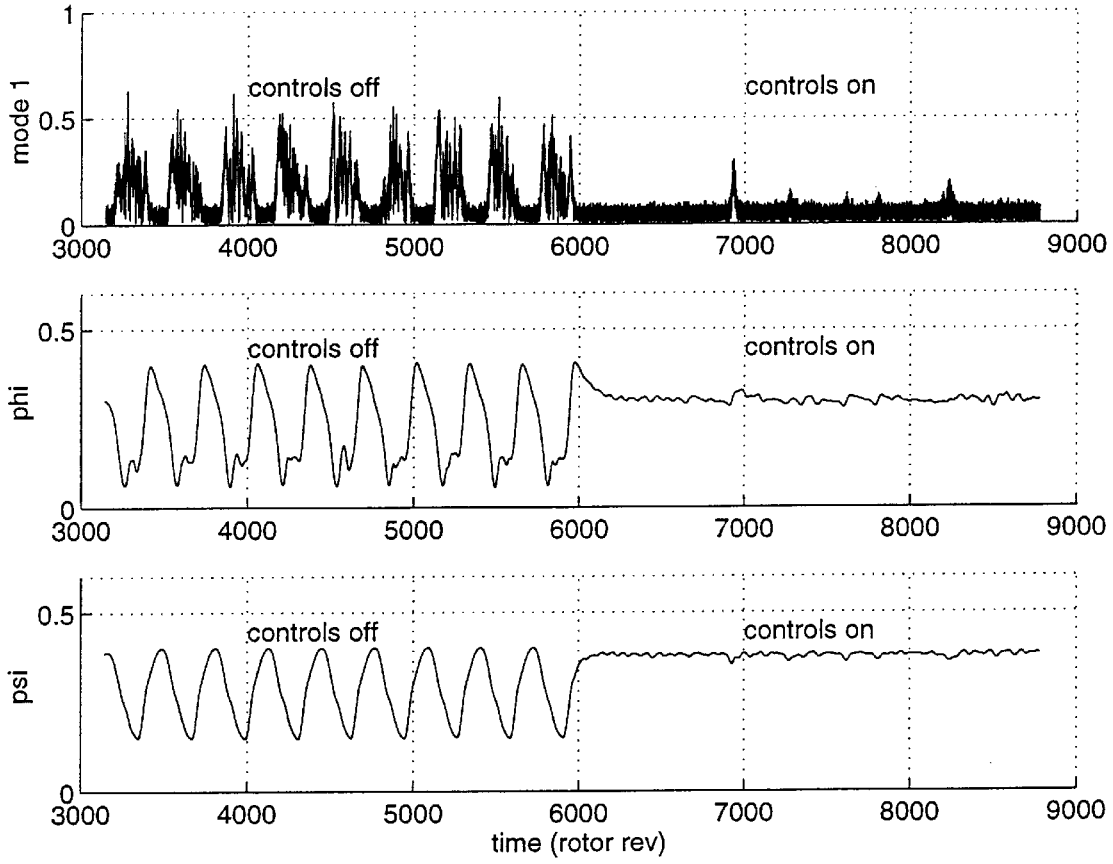
FIG. 20*b* shows time traces of $\psi$, $\phi$, and Mode 1 of the compressor with stall control using high speed bleed, surge control using slow speed bleed, and continuous air injection; control initially off and turned on at approximately 6000 rotor revolutions.
Figure 20C:
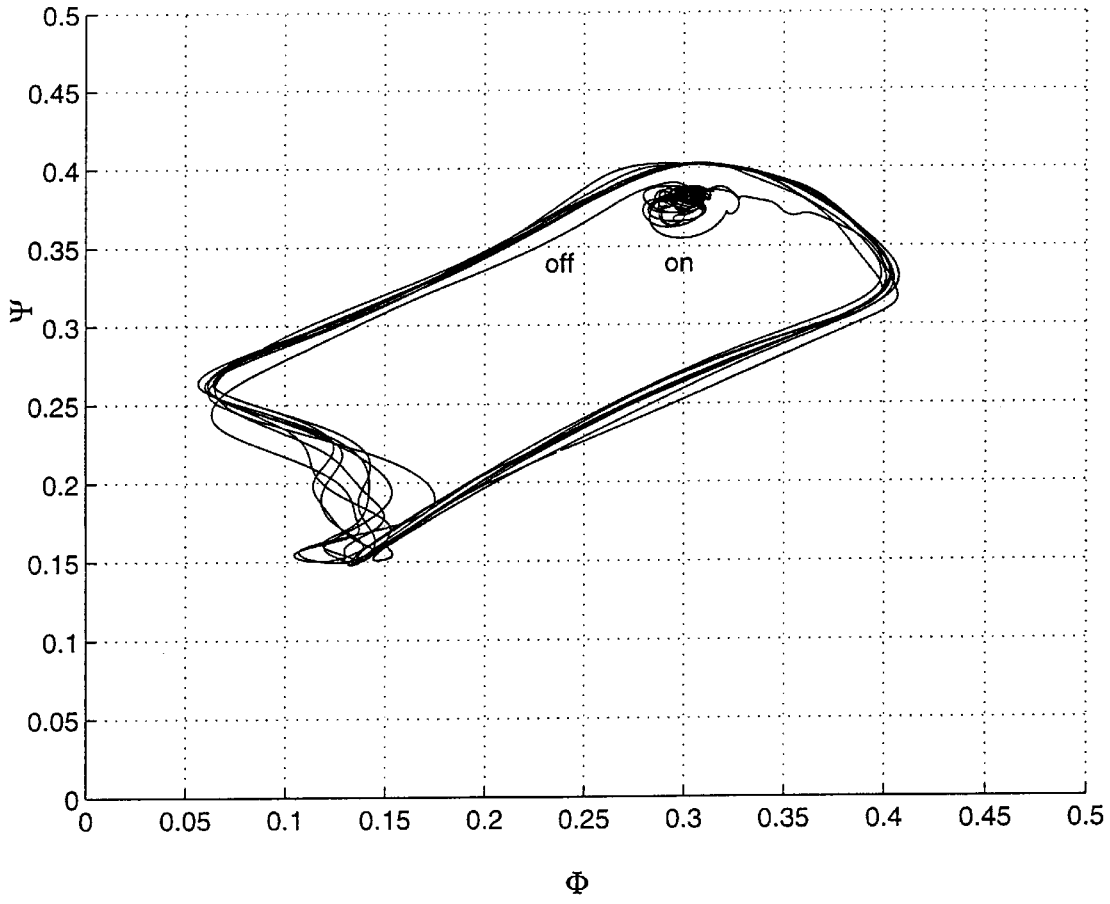
FIG. 20*c* is a graph of $\Phi$-$\Psi$ under same conditions as FIGS. 20*a* and 20*b*.

Control of stall and surge on the Caltech rig using pulsed air injection for stall and a low speed valve for surge has been achieved by Behnken et al. In order to demonstrate that the surge frequency is still sufficiently lower than that of rotating stall with the actuated compressor characteristics, and control of surge can be achieved using a low speed valve, a combined surge and stall control algorithm is implemented by using the high speed bleed valve with continuous air injection for stall and the slow bleed valve (disturbance bleed) for surge. The surge controller is implemented with a proportional feedback on $\phi$. The combined stall-surge control of the Caltech compressor rig using the high speed valve for stall with the Liaw-Abed control law and the low speed valve for surge with a surge control law proposed by Eveker et al. of the form $$u_{surge}=k_s\phi$$

is implemented, with the final control law given by $$u=k_{RS}J+k_S\phi$$

and the combined control law for rotating stall and surge taking the form $$\Phi_T(\psi)=(\gamma+k_{RS}J+k_S\phi)\sqrt{\psi}$$

where $k_{RS}$ is the gain for rotating stall control and $k_S$ that for surge control. The continuous air injection setting used for this test is 30° in the opposite direction of the rotor rotation and 50 psig. Control is initially turned off and the system is surging. Control is then activated at approximately 6000 rotor revolutions and the system is stable. FIG. 20*a* shows the time traces of the high and low speed bleed valve control signals, FIG. 20*b* shows the time traces of the flow, pressure, and the first Fourier mode signals, and FIG. 20*c* shows the pressure coefficient versus the flow coefficient. As the figures show, control of surge using a low speed valve is successful and the surge frequency is approximately the same as that of the operation with the unactuated compressor characteristic (1.7 Hz).

An examination of the open-loop compressor characteristic in FIG. 17*a* reveals that the value of the flow at the point of unstall 400 is less than that at the point of stall inception 410. This behavior is different than that in the unactuated open-loop system and suggests a change in the compressor characteristic. To identify the compressor characteristic of interest, an algorithm proposed by Behnken is used. The algorithm uses surge cycle data and the expanded surge model to recover the compressor characteristic description. The basic surge model is Equation (1) with J set to 0. The expanded surge model takes into account the amplitudes of the first and second modes of rotating stall in the surge cycle without considering the time rate of change of the stall modes. A successful identification of the compressor characteristic is classified as one that gives a close fit to the time rate of change of the flow and pressure signals, as well as a tight bound of the compressor characteristic when the dynamic data is used for its computation.

Figure 21:
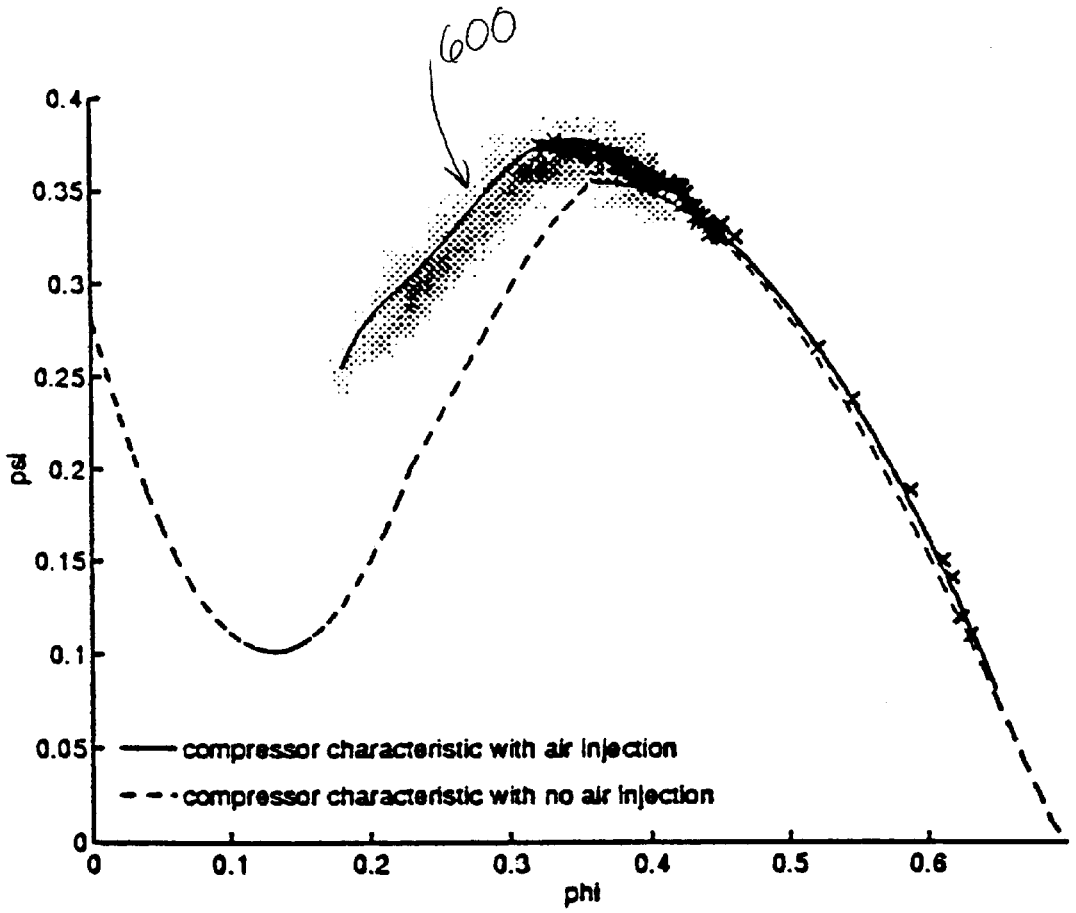
FIG. 21 is a graph showing identification of compressor characteristic with continuous air injection at 27° and 60 psi injector back pressure.

With a plenum attached, surge cycle data is taken and the algorithm for identifying the unstable part of the compressor characteristic as described by Behnken is applied. FIG. 21 shows the resulting identified compressor characteristic. The resulting identified compressor characteristic is more "filled out" on the left of the peak at 600. The crosses in FIG. 21 are experimental data points of the stable side of the compressor characteristic with continuous air injection, the right solid curve the polynomial fit of the experimental data points, the left solid curve the identified unstable part of the characteristic in the presence of continuous air injection, the dashed the compressor characteristic with no air injection, and the shaded region the experimental surge cycles data for $\psi_c(\phi)$ in the presence of air injection. As shown in the figure, the shape of the compressor characteristic is shifted in the presence of continuous air injection.

The shifting of the compressor characteristic serves to reduce the bandwidth and rate requirement of the bleed valve for control of rotating stall. To observe this phenomenon, Equation (2) can serve as the tool to a simplified view of the reality. Equation (2) gives a formula to the minimum gain required for stabilization of rotating stall at the peak of the compressor characteristic. A 4th order polynomial fit to the unactuated compressor characteristic in FIG. 21 gives $$\Psi_c(\phi)=0.71-10.59\phi+60.80\phi^2-126.39\phi^3+87.48\phi^4,$$

with the peak at $(\phi,\psi)$=(0.38, 0.35), and the second and third derivative values of −14.99 and 39.45 respectively. A similar fit to the actuated characteristic gives $$\Psi_c(\phi)=0.78-8.82\phi+49.49\phi^2-104.77\phi^3+74.1331\phi^4,$$

with the peak at $(\phi,\psi)$=(0.35, 0.38), and the second and third derivative values of −12.07 and −5.92 respectively. Equation (2) applied to the unactuated characteristic given $K_{min,unact}$= 4.00 and to the actuated case gives $K_{min,act}$=2.16<$K_{min,unact}$.

The experiment, the compressor characteristic identification, and Equation (2) show that the shifting of the compressor characteristic can be used to reduce the required bandwidth of a bleed actuator. In this case, continuous air injection is used to achieve the shifting. In fact, the use of any mechanism that results in a shifting of the compressor characteristic should serve as a tool to reduce the bandwidth and rate requirement of the bleed actuator. Some alternate mechanisms for shifting the compressor characteristic are as follows—Air Injection: air injection at the tip of the rotor is shown in this paper to shift the nominal compressor characteristic and reduce the bandwidth and rate requirement of a bleed valve used for control of rotating stall; air in injection at other regions of the rotor, the stator (in the case of lower reaction compressors where a significant portion of the pressure rise occurs in the stator), and both can be used to achieve the same purpose; Casing Treatments: casing treatments are grooves on the wall of the casing of a compressor on the rotor or stator; stability enhancement has been reported for several patterns; for a more detailed introductory discussion, see Greitzer; Guide Vanes: complete or partial vanes that redirect the air flow of a compression system may be used to shift the compressor characteristic;Distortion: although most kinds of distortion reduce the region of stable compressor operation, hub distortion on tip-loaded compressors has been shown to improve the stability of compressor operation; and Mistuning: mistuning is used primarily as a method of passive control of flutter in compressors; mistuning refers to the breaking of symmetry by changing certain properties (e.g. stiffness of blade) of some but not all of the blades.

Active control of rotating stall on the rig 100 is achieved by using a high speed bleed valve in combination with continuous air injection. Actuation of the compressor characteristic occurs by varying the amount of continuous air injection on the system. The effect of the air injection is the shifting of the compressor characteristic, thereby affecting both the stable and unstable side of the characteristic. This change of system characteristics reduces the bandwidth and magnitude requirements of a bleed actuator in performing bleed valve controls of rotating stall. In addition, the bleed valve rate requirement is reduced.

The combination of compressor characteristic identification tools and the analytic relations set forth above, provide additional tools to achieve compressor rotating stall stabilization. These tools include: Fixed Bleed Valve and Unactuated Compressor—given a description of the characteristics of a bleed valve, an estimate of a compressor characteristic for which peak stabilization of rotating stall can be achieved using the bleed actuator of interest can be obtained; the actuation of the compressor characteristic can then be realized through the use of techniques such as continuous air injection; Fixed Compressor—given a single set of surge cycle data, the compressor characteristic can be identified and various controller gain and bleed actuator rate estimates can be obtained for purposes of rotating stall stabilization; a bleed valve can then be designed for the compressor; and Fixed Bleed Valve—given multiple sets of surge cycles, compressor characteristics can be identified and the "optimal" compressor characteristic in terms of minimum rate limit requirements can be obtained.

Other embodiments are within the following claims.

What is claimed is:

1. In a compressor including an actuator of predefined limited bandwidth and rate requirements, a method performed in off-line operation comprising:

sensing surge data including pressure and velocity data of the compressor under varying compressor operating conditions;

determining a compressor characteristic on the basis of the surge data; and modifying the compressor to shift the compressor characteristic, the shifted compressor characteristic having the effect of lowering the bandwidth and rate requirements of the compressor on the actuator resulting in improved active stabilization control of rotating stall thereby during on-line operation.

2. The method of claim 1, wherein the shifting of the compressor characteristic involves switching on continuous air injection.

3. The method of claim 2, wherein the shifting of the compressor characteristic involves providing air injection at least the tip of a rotor in the compressor.

4. The method of claim 2, further comprising the following on-line operation performed steps:

sensing stall data, including pressure and velocity data; and adjusting the actuator to effect active stabilization control of rotating stall.

5. The method of claim 1, further comprising the following on-line operation performed steps:

sensing stall data, including pressure and velocity data; and adjusting the actuator to effect active stabilization control of rotating stall.

6. The method of claim 5, wherein the shifting of the compressor characteristic involves providing air injection at least the stator.

7. The method of claim 5, wherein the shifting of the compressor characteristic involves making casing treatments.

8. The method of claim 5, wherein the shifting of the compressor characteristic involves redirecting air flow with guide vanes.

9. The method of claim 5, wherein the shifting of the compressor characteristic involves correcting distortion levels in the compressor.

10. The method of claim 5, wherein the shifting of the compressor characteristic involves correcting mistuning levels in the compressor.

11. The method of claim 5, wherein the actuator includes at least a high speed bleed valve and a low speed bleed valve.

12. In a compressor including an actuator of predefined limited bandwidth and rate requirements, a method comprising:

sensing, in off-line operation, surge data including pressure and velocity data of the compressor under varying compressor operating conditions;

determining, in off-line operation, a compressor characteristic on the basis of the surge data; and modifying, in on-line operation, the compressor to shift the compressor characteristic, the shifted compressor characteristic having the effect of lowering the bandwidth and rate requirements of the compressor on the actuator resulting in improved active stabilization control of rotating stall thereby.

13. The method of claim 12, wherein the step of modifying the compressor on-line includes switching on continuous air injection.

14. The method of claim 13, wherein the shifting of the compressor characteristic involves providing air injection at least the tip of a rotor in the compressor.

15. The method of claim 14, further comprising the following on-line operation performed steps:

sensing stall data, including pressure and velocity data; and adjusting the actuator to effect active stabilization control of rotating stall.

16. The method of claim 12, further comprising the following on-line operation performed steps:

sensing stall data, including pressure and velocity data; and adjusting the actuator to effect active stabilization control of rotating stall.

17. The method of claim 12, wherein the shifting of the compressor characteristic involves providing air injection at least the stator.

18. The method of claim 12, wherein the shifting of the compressor characteristic involves redirecting air flow with guide vanes.

19. The method of claim 12, wherein the shifting of the compressor characteristic involves correcting distortion levels in the compressor.

20. The method of claim 12, wherein the shifting of the compressor characteristic involves correcting mistuning levels in the compressor.

21. The method of claim 12, wherein the actuator includes at least a high speed bleed valve and a low speed bleed valve.

22. A compressor including an actuator of predefined limited bandwidth and rate requirements, including a characteristic modifier operable in off-line operation comprising:

means for determining a compressor characteristic on the basis of sensed surge data including pressure and velocity data of the compressor under varying compressor operating conditions; and means for modifying the compressor to shift the compressor characteristic, the shifted compressor characteristic having the effect of lowering the bandwidth and rate requirements of the compressor on the actuator to provide improved active stabilization control of rotating stall thereby during on-line operation.

23. The compressor of claim 22, further comprising a sensing device generating the surge data.

24. The compressor of claim 23, wherein the sensing device includes a plurality of pressure transducers.

25. The compressor of claim 24, wherein the plurality of pressure transducers are evenly distributed circumferentially around the compressor.

26. The compressor of claim 22, wherein the shifted compressor characteristic is adapted to add mass, momentum and energy to the compressor.

27. The compressor of claim 22, wherein the shifting of the compressor characteristic involves switching on continuous air injection.

28. The compressor of claim 27, wherein continuous air injection is provided by a plurality of air injectors.

29. The compressor of claim 28, wherein the plurality of air injectors are adapted to vary air flow injection angle relative to axial air flow direction.

30. The compressor of claim 29, wherein the injection angle is variable between 27° and 40°.

31. The compressor of claim 28, wherein the plurality of air injectors are adapted to vary injector back pressure.

32. The compressor of claim 31, wherein the injector back pressure of the plurality of air injectors is variable between 40 psig and 60 psig.

33. The compressor of claim 28, wherein the plurality of air injectors are positioned close to an outer casing to affect a favorable shifting of the compressor characteristic.

34. The compressor of claim 28, wherein the plurality of air injectors are positioned near tip or hub of compressor blades comprised by the compressor.

35. The compressor of claim 22, wherein the shifting of the compressor characteristic involves making casing treatments.

36. The compressor of claim 22, wherein the shifting of the compressor characteristic involves redirecting air flow with guide vanes.

37. The compressor of claim 22, wherein the shifting of the compressor characteristic involves correcting hub distortion.

38. The compressor of claim 22, wherein the shifting of the compressor characteristic involves changing individual blade properties within a compressor to make the compressor non-uniform circumferentially.

39. The method of claim 22, wherein the individual blade properties include at least one of angle of attack, mass, stiffness, and geometry.

40. The compressor system of claim 22, wherein the actuator includes a plurality of bleed valves mounted axially.

41. The compressor system of claim 22, wherein the actuator includes a plurality of bleed valves mounted circumferentially.

42. The compressor system of claim 22, wherein the actuator includes a high speed valve and a low speed valve.

43. The compressor system of claim 22, wherein:

the high speed valve has a small signal bandwidth of about 200 Hz and a large signal bandwidth of about 60 Hz, and has a magnitude of saturation of about 12% of compressor flow at stall inception point; and the low speed bleed valve has a small signal bandwidth of about 50 Hz and a large signal bandwidth of about 15 Hz, and has a magnitude of saturation of about 30% of compressor flow at stall inception point.

44. A compressor including an actuator of predefined limited bandwidth and rate requirements, including a characteristic modifier comprising:

means, operable in off-line operation, for determining a compressor characteristic on the basis of sensed surge data including pressure and velocity data of the compressor under varying compressor operating conditions; and means, operable in on-line operation, for modifying the compressor to shift the compressor characteristic, the shifted compressor characteristic having the effect of lowering the bandwidth and rate requirements of the compressor on the actuator to provide improved active stabilization control of rotating stall thereby.

45. The compressor of claim 44, further comprising a sensing device generating the surge data.

46. The compressor of claim 45, wherein the sensing device includes a plurality of pressure transducers.

47. The compressor of claim 46, wherein the plurality of pressure transducers are evenly distributed circumferentially around the compressor.

48. The compressor of claim 44, wherein the shifted compressor characteristic is adapted to add mass, momentum and energy to the compressor.

49. The compressor of claim 44, wherein the shifting of the compressor characteristic involves switching on continuous air injection.

50. The compressor of claim 49, wherein continuous air injection is provided by a plurality of air injectors.

51. The compressor of claim 50, wherein the plurality of air injectors are adapted to vary air flow injection angle relative to axial air flow direction.

52. The compressor of claim 51, wherein the injection angle is variable between 27° and 40°.

53. The compressor of claim 50, wherein the plurality of air injectors are adapted to vary injector back pressure.

54. The compressor of claim 53, wherein the injector back pressure of the plurality of air injectors is variable between 40 psig and 60 psig.

55. The compressor of claim 50, wherein the plurality of air injectors are positioned close to an outer casing to affect a favorable shifting of the compressor characteristic.

56. The compressor of claim 50, wherein the plurality of air injectors are positioned near tip or hub of compressor blades comprised by the compressor.

57. The compressor of claim 44, wherein the shifting of the compressor characteristic involves correcting hub distortion.

58. The compressor system of claim 44, wherein the actuator includes a plurality of bleed valves mounted axially.

59. The compressor system of claim 44, wherein the actuator includes a plurality of bleed valves mounted circumferentially.

60. The compressor system of claim 40, wherein the actuator includes a high speed valve and a low speed valve.

61. The compressor system of claim 40, wherein:

the high speed valve has a small signal bandwidth of about 200 Hz and a large signal bandwidth of about 60 Hz, and has a magnitude of saturation of about 12% of compressor flow at stall inception point; and the low speed bleed valve has a small signal bandwidth of about 50 Hz and a large signal bandwidth of about 15 Hz, and has a magnitude of saturation of about 30% of compressor flow at stall inception point.

* * * * *